US009695821B2

(12) United States Patent
Patterson et al.

(10) Patent No.: US 9,695,821 B2
(45) **Date of Patent: *Jul. 4, 2017**

(54) COMPRESSOR WITH ROTATING CAM AND SLIDING END VANES

(71) Applicant: Albert's Generator Services Inc., West Lorne (CA)

(72) Inventors: Albert W. Patterson, West Lorne (CA); Tyler J. E. Clark, Appin (CA)

(73) Assignee: Albert's Generator Services Inc., West Lorne (CA)

( * ) Notice: Subject to any disclaimer, the term of this patent is extended or adjusted under 35 U.S.C. 154(b) by 238 days.

This patent is subject to a terminal disclaimer.

(21) Appl. No.: 14/663,816

(22) Filed: Mar. 20, 2015

(65) Prior Publication Data

US 2015/0192128 A1 Jul. 9, 2015

Related U.S. Application Data

(63) Continuation-in-part of application No. 13/742,663, filed on Jan. 16, 2013, now Pat. No. 8,985,980.

(51) Int. Cl.

| | |
|---|---|
| ***F03C 2/00*** | (2006.01) |
| ***F01C 21/08*** | (2006.01) |
| ***F04C 29/02*** | (2006.01) |
| ***F04C 2/356*** | (2006.01) |
| ***F01C 21/10*** | (2006.01) |

(Continued)

(52) U.S. Cl.

CPC ..... *F04C 28/18* (2013.01); *F01C 21/0845* (2013.01); *F04C 2/3448* (2013.01); *F04C 2/3568* (2013.01); *F01C 21/108* (2013.01)

(58) Field of Classification Search

CPC ..... F04C 28/18; F04C 2/3448; F04C 2/3568; F01C 21/0845; F01C 21/108

USPC ..... 418/216, 219, 228–232, DIG. 1

See application file for complete search history.

(56) References Cited

U.S. PATENT DOCUMENTS

| | | | |
|---|---|---|---|
| 2,324,610 | A | 7/1943 | Williams |
| 2,902,942 | A | 9/1959 | Pelladeau |
| 3,213,759 | A | 10/1965 | Mellinger |

(Continued)

FOREIGN PATENT DOCUMENTS

| | | |
|---|---|---|
| CA | 1108009 | 9/1981 |
| WO | 03/044371 | 5/2003 |

OTHER PUBLICATIONS

International Searching Authority, International Search and Written Opinion for PCT/CA2014/000020, mailed Apr. 11, 2014.

*Primary Examiner* — Hoang Nguyen
(74) *Attorney, Agent, or Firm* — Bereskin & Parr LLP

(57) ABSTRACT

An apparatus for compressing or pumping fluid includes a housing having an interior chamber. A rotating cam is rotatably mounted within an interior chamber and includes a reversible cam body configured to enable fluid to flow in a foreword direction and a reverse direction. The reversible cam body has a first sloped annular channel formed therein. The first end of the reversible cam body includes a ramp up portion, a ramp down portion, and inner and outer circumferential sidewalls that circumscribe the ramp to define the first sloped annular channel. The apparatus may include a circumferential cam gear located on the outer circumferential sidewall and a secondary drive shaft with a pinion gear to rotate the circumferential cam gear.

21 Claims, 22 Drawing Sheets

(51) Int. Cl.
*F04C 28/18* (2006.01)
*F04C 2/344* (2006.01)

(56) References Cited

U.S. PATENT DOCUMENTS

| | | | | |
|---|---|---|---|---|
| 3,456,594 | A | 7/1969 | Cosby | |
| 3,787,153 | A | 1/1974 | Williams | |
| 3,994,638 | A | 11/1976 | Garland et al. | |
| 4,080,117 | A | 3/1978 | Rasmussen | |
| 4,093,408 | A | 6/1978 | Yamaguchi | |
| 4,437,823 | A | 3/1984 | Tigane | |
| 4,561,831 | A | 12/1985 | Mallen-Herrero et al. | |
| 4,573,892 | A | 3/1986 | DuFrene | |
| 4,653,603 | A * | 3/1987 | DuFrene | A47C 7/027 180/426 |
| 6,773,244 | B2 * | 8/2004 | Lee | F04C 29/026 418/216 |
| 6,893,241 | B2 * | 5/2005 | Yang | F04C 18/3568 418/124 |
| 8,985,980 | B2 * | 3/2015 | Patterson | F01C 21/0845 418/216 |
| 2003/0108438 | A1 * | 6/2003 | Kim | F04C 18/3568 417/312 |
| 2004/0005236 | A1 | 1/2004 | Lee | |

* cited by examiner

COMPRESSOR WITH ROTATING CAM AND SLIDING END VANES

RELATED APPLICATIONS

This application is a continuation-in-part of U.S. patent application Ser. No. 13/742,663 filed on Jan. 16, 2013, and entitled "Compressor with Rotating Cam and Sliding End Vanes", the entire contents of which are hereby incorporated by reference herein for all purposes.

TECHNICAL FIELD

The embodiments disclosed herein relate to apparatus for compressing or pumping fluids, and particular to such apparatus having one or more sliding end vanes for engaging a rotating cam.

BACKGROUND

Compressors and pumps are commonly used to transfer mechanical energy to fluids. Some of these compressors and pumps have rotary designs, which can provide efficient and continuous energy transfer. However, these rotary designs are often complicated and expensive to manufacture and maintain.

One example of a rotary compressor is described in U.S. Patent Application Publication No. 2003/0108438 (Kim et al.). The compressor includes a cylinder assembly having a compression space through which suction passages and discharge passages are connected. A slanted compression plate is installed in the compression space and divides the compression space into two parts. The slant plate is rotatably connected to a rotation driving unit. Vanes are located on both sides of the slant compression plate to separate each of the two partitioned compression spaces into a suction space and a compression space. As the compression plate rotates, the vanes slide along the compression plate so that the fluid enters the suction space while fluid in the compression space is compressed and discharged.

One problem with the compressor of Kim et al. is that it can be difficult to maintain seals around the suction space and compression space on each side of the compression plate. Furthermore, it can be difficult to perform maintenance on the vanes or the slanted compression plate in the event that either of them wears down or breaks.

In view of the above, there is a need of a new apparatus for compressing or pumping fluids.

SUMMARY

According to some embodiments, there is an apparatus for compressing or pumping fluid. The apparatus comprises a housing having an interior chamber. The housing includes a first end wall on one side of the interior chamber. The first end wall has a fluid inlet and a fluid outlet. A rotating cam is rotatably mounted within the interior chamber. The rotating cam comprises a cam body having a first end located adjacent to the first end wall. The first end has a first sloped annular channel formed therein. The first sloped annular channel includes a ramp that is circumscribed by inner and outer circumferential sidewalls. The apparatus also comprises a first end vane slidably mounted within a slot in the first end wall so as to extend into the first sloped annular channel for sliding therein as the rotating cam rotates. The first end vane is biased towards the ramp so as to divide the sloped annular channel into an inlet chamber and an outlet chamber such that, as the rotating cam rotates, the inlet chamber expands and communicates with the fluid inlet for receiving the fluid, and the outlet chamber contracts and communicates with the fluid outlet for expelling the fluid.

The apparatus may further comprise a vane housing removably attached to the first end wall. The vane housing has a vane slot for slidably receiving the end vane therein. The apparatus may further comprise a biasing element within the vane housing for biasing the end vane against the ramp.

The first end vane may have a tapered tip, and the inner and outer circumferential sidewalls may be tapered inwardly towards the ramp corresponding to the tapered tip of the end vane.

The cam body may have a second sloped annular channel formed therein, and the apparatus may further comprise a second end vane slidably mounted to the housing and extending into the second sloped annular channel for sliding within the second sloped annular channel as the rotating cam rotates.

The second sloped annular channel may be formed on a second end of the cam body that is opposite to the first end, and the second end vane may be slidably mounted to a second end wall of the housing that is located opposite to the first end wall.

The second sloped annular channel may be formed on the first end of the cam body concentrically with the first sloped annular channel, and the second end vane may be slidably mounted to the first end wall of the housing.

The cam body may be a cylindrical block. The ramp may extend inwardly into the cylindrical block along a helical path. The helical path may start and finish at a raised portion.

The housing may include a cylindrical shell and the first end wall may be removably attached to the cylindrical shell.

The end vane may be configured to seal against the ramp and the inner and outer circumferential sidewalls.

The ramp may have a raised portion for maintaining contact with the first end wall as the rotating cam rotates, and the raised portion may cooperate with the first end vane to divide the first sloped annular channel into the inlet chamber and the outlet chamber.

According to some embodiments, there is an apparatus for compressing or pumping fluid. The apparatus comprises a housing having an interior chamber. The housing includes two end walls located on opposing sides of the interior chamber. Each end wall has a fluid inlet and a fluid outlet. A rotating cam is rotatably mounted within the interior chamber. The rotating cam comprises a cam body having two ends. Each end is located adjacent to one of the end walls and has at least one sloped annular channel formed therein. Each sloped annular channel includes a ramp that is circumscribed by inner and outer circumferential sidewalls. The apparatus also includes at least two end vanes. Each end vane is slidably mounted within a slot in one of the end walls so as to extend into a respective one of the sloped annular channels for sliding therein as the rotating cam rotates. Each end vane is biased towards the ramp so as to divide the respective sloped annular channel into an inlet chamber and an outlet chamber such that, as the rotating cam rotates, the inlet chamber expands and communicates with the fluid inlet for receiving the fluid, and the outlet chamber contracts and communicates with the fluid outlet for expelling the fluid.

The apparatus may further comprise at least two vane housings. Each vane housing may be removably attached to one of the end walls. The vane housing may have a vane slot for slidably receiving one of the end vanes therein.

Each end vane may have a tapered tip, and the inner and outer circumferential sidewalls of each respective sloped annular channel may be tapered inwardly towards the ramp corresponding to the tapered tip of the end vane.

Each end of the cam body may at least two sloped annular channels arranged concentrically therein, and wherein there are at least two end vanes slidably mounted to each of the end walls for extending into a respective one of the at least two sloped annular channels.

The cam body may be formed as a cylindrical block. The ramp of each sloped annular channel may extend inwardly into the cylindrical block along a helical path. The ramp of each sloped annular channel may have a raised portion for maintaining contact with the respective end wall as the rotating cam rotates, and the raised portion may cooperate with each respective end vane to divide the sloped annular channel into the inlet chamber and the outlet chamber.

According to some embodiments, there is an apparatus for compressing or pumping fluid. The apparatus includes a housing having an interior chamber. The housing includes a first end wall on one side of the interior chamber. The first end wall has a fluid inlet and a fluid outlet. The apparatus includes a rotating cam rotatably mounted within the interior chamber. The rotating cam comprises a reversible cam body configured to enable fluid to flow in a forward direction when the rotating cam is rotated in a forward direction, and a reverse direction when the rotating cam is rotated in a reverse direction. The reversible cam body has a first end located adjacent to the first end wall. The first end has a first sloped annular channel formed therein. The first end of the reversible cam body includes a ramp up portion, a ramp down portion, and inner and outer circumferential sidewalls that circumscribe the ramp to define the first sloped annular channel. The apparatus includes a first end vane slidably mounted within a slot in the first end wall so as to extend into the first sloped annular channel for sliding therein as the rotating cam rotates. The first end vane is biased towards the ramp so as to divide the sloped annular channel into an inlet chamber and an outlet chamber such that, as the rotating cam rotates, the inlet chamber expands and communicates with the fluid inlet for receiving the fluid, and the outlet chamber contracts and communicates with the fluid outlet for expelling the fluid.

According to some embodiments, there is an apparatus for compressing or pumping fluid. The apparatus includes a housing having an interior chamber. The housing includes a first end wall on one side of the interior chamber. The first end wall has a fluid inlet and a fluid outlet. The apparatus includes a rotating cam rotatably mounted within the interior chamber. The rotating cam includes a reversible cam body configured to enable fluid to flow in a forward direction and a reverse direction. The reversible cam body has a first sloped annular channel formed therein. The first end of the reversible cam body includes a ramp up portion, a ramp down portion, and inner and outer circumferential sidewalls that circumscribe the ramp to define the first sloped annular channel. The rotating cam includes a circumferential cam gear located on the outer circumferential sidewall. The apparatus includes a secondary drive shaft with a pinion gear to rotate the circumferential cam gear. The apparatus includes a first end vane slidably mounted within a slot in the first end wall so as to extend into the first sloped annular channel for sliding therein as the rotating cam rotates. The first end vane is biased towards the ramp so as to divide the sloped annular channel into an inlet chamber and an outlet chamber such that, as the rotating cam rotates, the inlet chamber expands and communicates with the fluid inlet for receiving the fluid, and the outlet chamber contracts and communicates with the fluid outlet for expelling the fluid.

The reversible cam body may include a raised portion and a lowered portion. The raised portion may be generally flat and sized to cover the fluid inlet and the fluid outlet.

The housing may have a second end wall on an opposite side of the interior chamber. The second end wall has a fluid inlet and a fluid outlet. The reversible cam body has a second end located adjacent to the second end wall. The second end has a second sloped annular channel formed therein. The reversible cam body is double-ended such that the ramp up portion of the first end acts as a ramp down portion of the second end, the ramp down portion of the first end acts as a ramp up portion of the second end, the raised portion of the first end acts as a lowered portion of a second end, and the lowered portion of the first end acts as a raised portion on the second end.

The apparatus may include a second end vane located in a same location on opposite sides of the rotating cam. The second end vane is slidably mounted within a slot in the second end wall so as to extend into the second sloped annular channel for sliding therein as the rotating cam rotates.

The apparatus may include a connection assembly for mechanically tying the first and second end vanes together such that the end vanes move together.

The connection assembly may include a first push rod attached to the first end vane and a first tie bar, a second push rod attached to the end second vane and a second tie bar, and a tie rod for connecting the first and second push rods.

The apparatus may include a rod guide for supporting the tie rod and the first and second push rods.

The apparatus may include at least one bearing guide ring for bearing on the outer circumferential sidewall.

Each end of the cam body may have at least two interior chambers arranged concentrically therein.

The ramp up portions of the at least two interior chambers may be offset from each other by (1/n)*360 degrees, where n is the number of interior chambers.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of the present specification. In the drawings.

DETAILED DESCRIPTION

Figure 1:
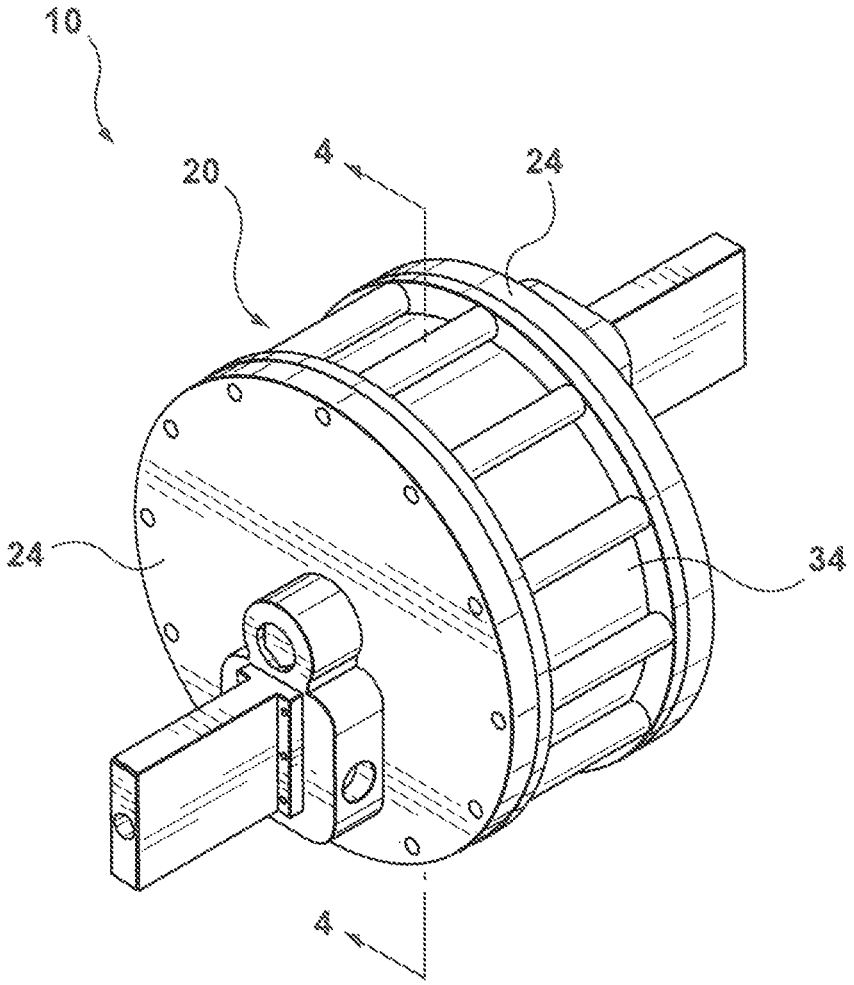
FIG. 1 is a perspective view of an apparatus for compressing or pumping fluids according to an embodiment of the present invention.
Figure 2:
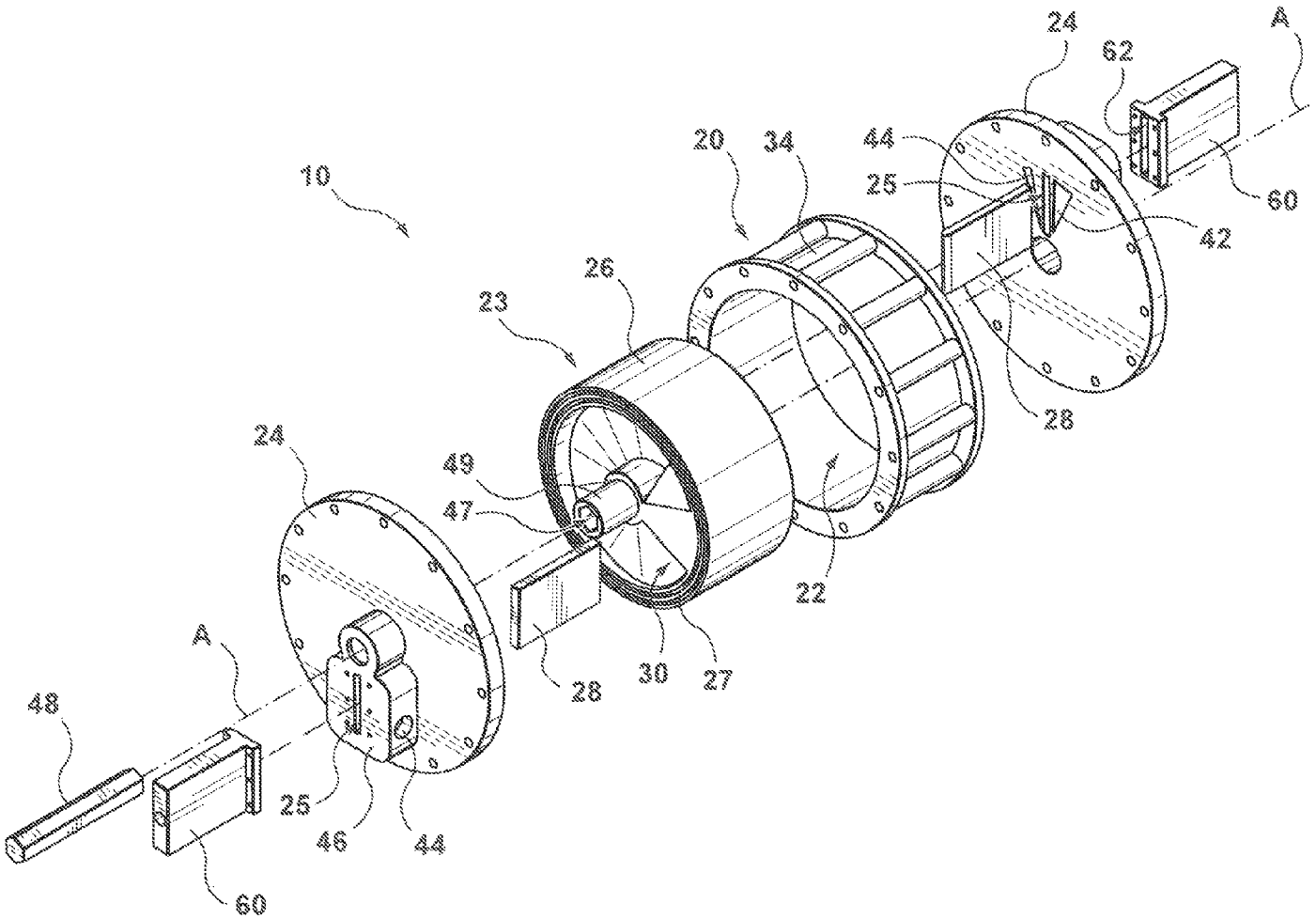
FIG. 2 is an exploded perspective view of the apparatus of FIG. 1.

Referring to FIGS. 1-4, illustrated therein is an apparatus 10 for use in compressing or pumping fluids. The apparatus 10 includes a housing 20 having an interior chamber 22 enclosed by two end walls 24. As shown in FIG. 2, a rotating cam 23 is rotatably mounted within the interior chamber 22, and two end vanes 28 are slidably mounted within a slot 25 in the end walls 24. The rotating cam 23 comprises a cam body 26 having two opposing ends 27 with cam surfaces thereon. Each end 27 is located adjacent to one of the end walls 24 of the housing 20. Furthermore, each cam surface is defined by a sloped generally annular channel 30 formed on each end 27 of the cam body 26 (only one sloped annular channel 30 can be seen in FIGS. 2 and 3). The end vanes 28 extend into the sloped annular channels 30 and divide each respective sloped annular channel 30 into an inlet chamber 30A and an outlet chamber 30B. In operation, when the rotating cam 23 rotates, the end vanes 28 slide within the sloped annular channels 30 so that the inlet chamber 30A expands and receives a fluid, while the outlet chamber 30B contracts and expels the fluid out from the apparatus 10.

Referring now to FIGS. 1 and 2, the housing 20 includes the two end walls 24 and a generally cylindrical shell 34 located therebetween. Together, the end walls 24 and the shell 34 cooperate to define the interior chamber 22. The interior chamber 22 is sized and shaped to receive the cam body 26. As shown, the interior chamber 22 generally has a cylindrical shape.

Each end wall 24 may be removably attached to the cylindrical shell 34, for example, using one or more removable fasteners 38 such as screws, bolts, locking clips, and the like. This allows access to the rotating cam 23 or end vanes 28, which can be beneficial when performing maintenance or repairs. In other examples, one of the end walls 24 may be affixed to the shell 34, or formed integrally therewith.

With reference to FIG. 2, each end wall 24 also includes a fluid inlet 42 and a fluid outlet 44. The fluid inlets and outlets 42 and 44 are generally aligned with the sloped annular channels 30 on the cam body 26. Thus, as the rotating cam 23 rotates, fluid can enter the sloped annular channels 30 through the inlet 42, and can then be expelled through the outlet 44.

The apparatus 10 may also include a manifold block 46 attached to each end wall 24. Each manifold block 46 may be formed with the fluid inlet and outlet 42 and 44 therein. In other examples, the inlet and outlet 42 and 44 may be formed directly on the end walls 24.

Each end wall 24 and manifold block 46 may also have a slot 25 for receiving the end vane 28 therethrough. The slot 25 is located between the inlet 42 and outlet 44.

Figure 3:
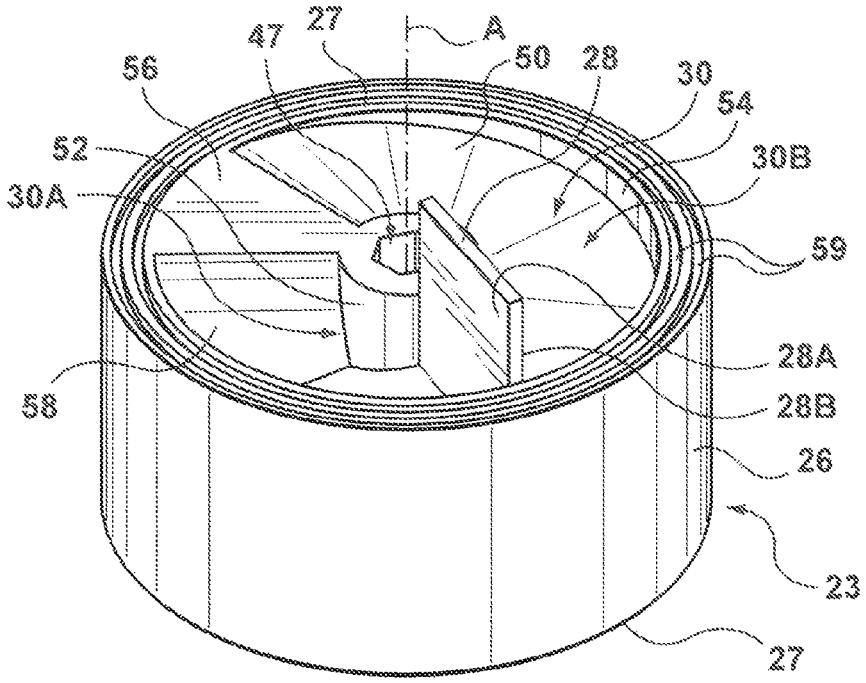
FIG. 3 is a perspective view of a rotating cam and an end vane of the apparatus of FIG. 1.
Figure 4:
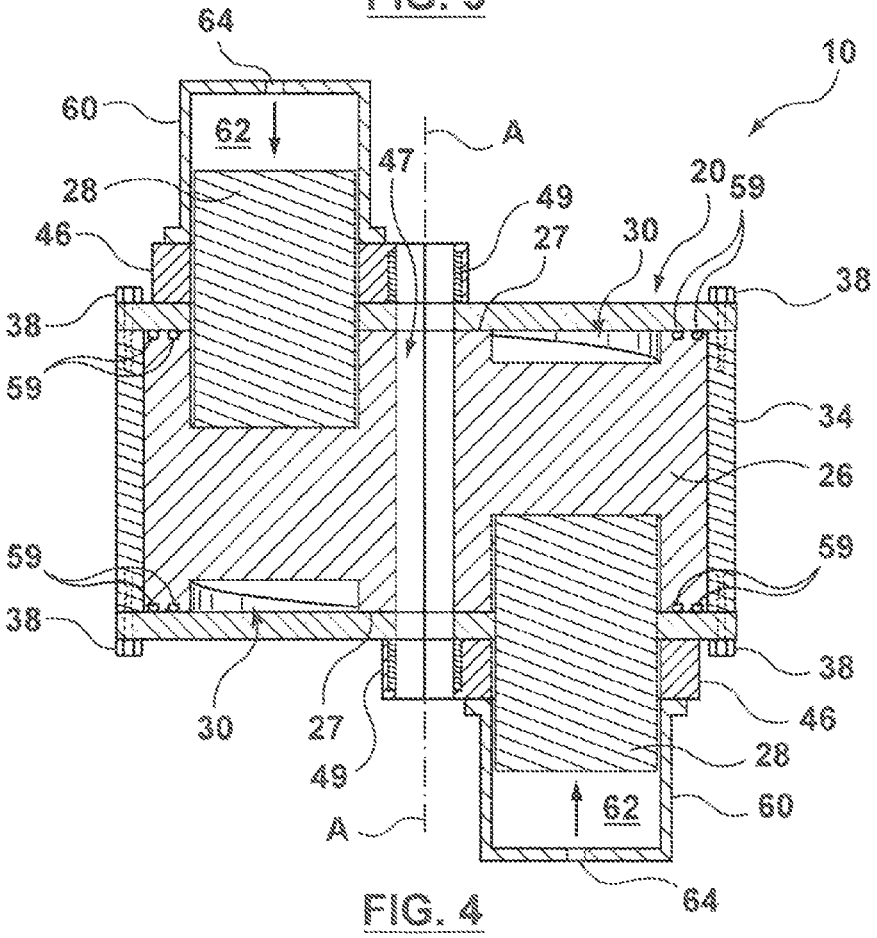
FIG. 4 is a cross-sectional view of the apparatus of FIG. 1 along the line 4-4.
Figure 11:
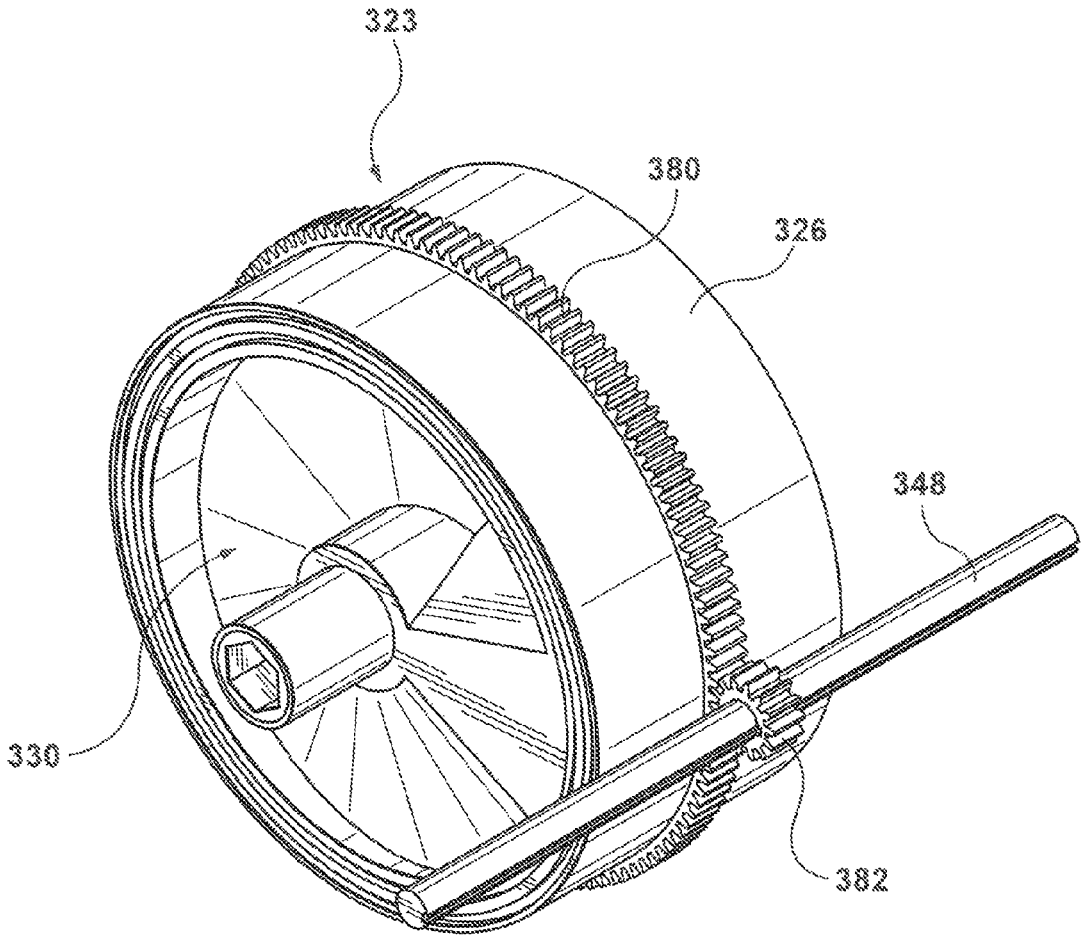
FIG. 11 is a perspective view of another rotatable cam that includes a circumferential gear driven by a pinion gear according to another embodiment of the present invention.

Referring now to FIGS. 2-4, the cam body 26 is rotatably mounted within the interior chamber 22 along a rotational axis A. The cam body 26 may be rotated about the rotational axis A by a drive mechanism. For example, the drive mechanism may include a drive shaft 48 extending through the end walls 24 and into a central bore 47 within the cam body 26. The shaft 48 and the central bore 47 generally have corresponding cross-sectional shapes (such as the hexagonal shape shown), which allows the shaft 48 to rotatably drive the cam body 26. As shown in FIGS. 2 and 4, a bushing 49 may be positioned between the shaft 48 and each end wall 24 to allow for free rotation of the shaft 48 relative to the end wall 24. While not shown, the shaft 48 may be driven by a motor or another source of rotary power. In some examples, the drive mechanism could have other configurations, such as a motorized gear assembly that drives a gear attached to the outer circumferential surface of the cam body 26 (e.g. as shown in FIG. 11).

With reference to FIG. 3, each sloped annular channel 30 formed in the cam body 26 includes a ramp 50 circumscribed by inner and outer circumferential sidewalls 52 and 54. The ramp 50 and sidewalls 52 and 54 are generally sized and shaped to allow the end vane 28 to slide within the sloped annular channel 30 while maintaining a seal therebetween. This can help isolate the inlet chamber 30A from the outlet chamber 30B.

The ramp 50 has a raised portion 56 that maintains contact with the end wall 24 as the rotating cam 23 rotates. As shown, the raised portion 56 may have a generally trapezoidal shape with a flat top that maintains contact with the end wall 24. In operation, the raised portion 56 cooperates with the end vane 28 to divide the sloped annular channel 30 into the inlet chamber 30A and the outlet chamber 30B. Specifically, the inlet chamber 30A is defined between the raised portion 56 and a front-side 28A of the end vane 28, and the outlet chamber 30B is defined between a back-side 28B of the end vane 28 and the raised portion 56.

In the illustrated embodiment, the cam body 26 is formed as a solid block of material having a generally cylindrical shape corresponding to the interior chamber 22. Making the cam body 26 from a solid block of material enables the formation of the ramp 50 and sidewalls 52 and 54. Specifically, the ramp 50 extends into the cylindrical block, and the sidewalls 52 and 54 extend axially outwardly from the ramp 50 to the outer ends of the cam body 26.

As shown, the ramp 50 may extend into the cam body 26 along a generally helical path. This can provide gradual compression or pumping of the fluid within the outlet chamber 30B. The helical path generally starts and finishes at the raised portion 56. Moreover, the ramp 50 includes a sloped entry 58 that drops off at the beginning of the helical path. This sloped entry 58 can help guide the end vane 28 down to the bottom of the ramp 50 as the inlet chamber 30A begins to expand.

As shown, there may be seals 59 between the cam body 26 and the end wall 24. For example, the seals 59 may include O-rings positioned on the ends 27 of the cam body 26 at locations radially outwardly from the sloped annular channels 30. This may help to seal fluid within the sloped annular channels 30. While not shown, there may also be seals located radially inwardly of the sloped annular channels 30 (e.g. around the shaft 48).

Referring again to FIGS. 2 and 3, the end vanes 28 are configured to slide within the sloped annular channels 30. In some examples, the end vanes 28 may be made from compressible materials such as soft plastics or rubberized materials. This can help provide a tight fit within the sloped annular channels 30 and can help seal and isolate the inlet chamber 30A from the outlet chamber 30B.

The end vanes 28 are also configured to reciprocate up and down along the rotational axis A as the end vanes 28 slide within the sloped annular channels 30. In order to allow this reciprocating movement, each end vane 28 may be received within a vane housing 60 that is attached to the end walls 24. Each vane housing 60 has a vane slot 62 for slidably receiving the end vane 28 therein. The vane slot 62 is generally aligned with the slot 25 in the end wall 24 and the manifold block 46. Furthermore, the combined length of the slot 25 and vane slot 62 is longer than the end vane 28. This extra length allows the end vane 28 to reciprocate along the rotational axis A as the end vane 28 slides within the sloped annular channel 30.

In some embodiments, the vane housing 60 may be removably attached to the end walls 24. For example, each vane housing 60 may be attached to a respective end wall 24 using one or more removable fasteners such as screws, bolts, locking clips, and the like. This can allow quick and easy replacement of the end vane 28 by detaching the vane housing 60 from the end wall 24, which can be particularly useful if the end vanes 28 wear down over time.

The end vanes 28 are generally biased toward the ramp 50. For example, the apparatus 10 may include a biasing element for biasing the end vane 28 into its respective sloped annular channel 30. For example, the vane housing 60 may include a port 64 for receiving a pressurized fluid that biases the end vane 28 against the ramp 50. The pressurized fluid may be supplied from a fluid pressure control system (not shown). In other examples, the biasing element may include another type of biasing element such as one or more springs (as with the embodiment shown in FIG. 7).

Figure 5A:
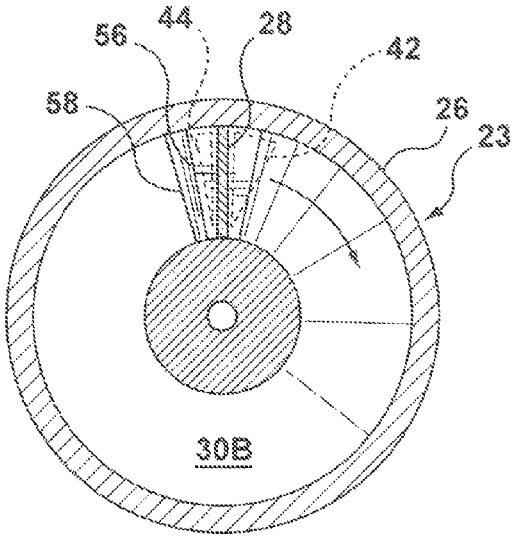
FIGS. 5A, 5B, 5C and 5D are top plan views of the cam and end vane shown in FIG. 3, in which fluid is being progressively received and discharged from a sloped annular channel as the cam rotates.

Referring now to FIGS. 5A-5D, operation of the apparatus 10 will now be described. In FIG. 5A, the raised portion 56 of the ramp 50 is rotationally aligned with the end vane 28. This may be referred to as a starting position. At this point, the sloped annular channel 30 may be empty, or filled with a fluid.

Figure 5B:
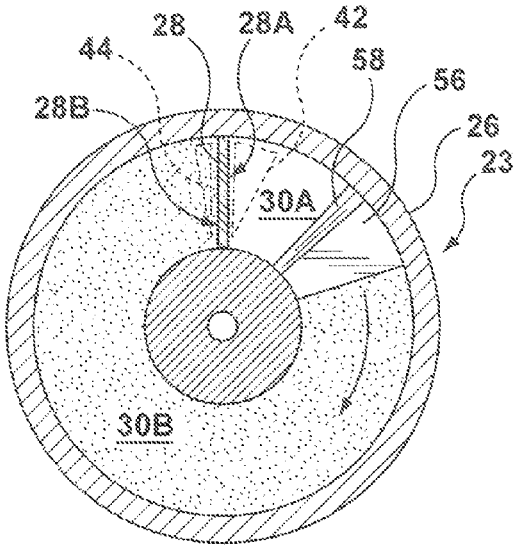

As will be described below, the apparatus 10 generally operates in two cycles, namely, an intake cycle and a discharge cycle. With reference to FIG. 5B, the intake cycle begins with the rotating cam 23 rotating clockwise. While rotating, the tip of the end vane 28 is biased downward and slides down the sloped entry 58. At this point, the inlet chamber 30A begins to form between the front-side 28A of the end vane 28 and the raised portion 56, and fluid enters the inlet chamber 30A through the inlet 42. As the rotating cam 23 continues to rotate (FIGS. 5C-5D), the inlet chamber 30A continues to expand and more fluid is drawn in. The inlet chamber 30A becomes filled with fluid after rotating the rotating cam 23 through one complete revolution.

Figure 5C:
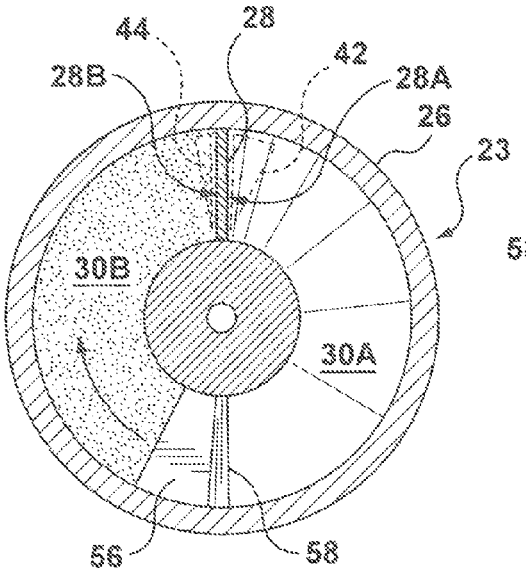
Figure 5D:
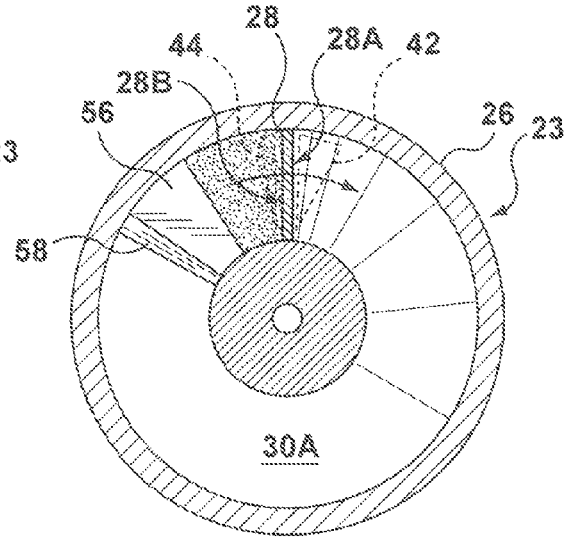

The discharge cycle begins on the next revolution of the rotating cam 23. Specifically, the fluid received within the inlet chamber 30A during the previous revolution is subsequently compressed or pumped during the next revolution. More specifically, as shown in FIGS. 5A and 5B, after the raised portion 56 passes by the end vane 28, the outlet chamber 30B extending between the raised portion and the back-side 28B is generally filled with fluid from the previous rotation (i.e. the inlet chamber 30A from the previous revolution becomes the outlet chamber 30B for the next revolution). As shown in FIGS. 5B-5D, further rotation of the rotating cam 23 causes the space between the raised portion 56 and the back-side 28B of the end vane 28 to decrease. This contraction of the outlet chamber 30B can be used to pump fluid (e.g. by keeping the fluid outlet 44 open), or to compress fluid (e.g. by restricting flow through the fluid outlet 44). For example, as shown in FIGS. 5B-5C, the fluid outlet 44 may be kept closed so that the fluid within the outlet chamber 30B gradually compresses as the rotating cam 23 continues rotating. When the rotating cam 23 reaches a particular point (e.g. the point shown in FIG. 5D), the fluid outlet 44 may be opened and the compressed fluid may be pumped out through the fluid outlet 44. The opening and closing of the outlet 44 may be controlled using a valve (not shown).

During regular operation, the intake cycle and discharge cycle occur generally contemporaneously or simultaneously with each other such that fluid is being discharged from the outlet chamber 30B while fluid is also being received in the inlet chamber 30A. This allows generally continuous operation of the apparatus 10.

Figure 6:
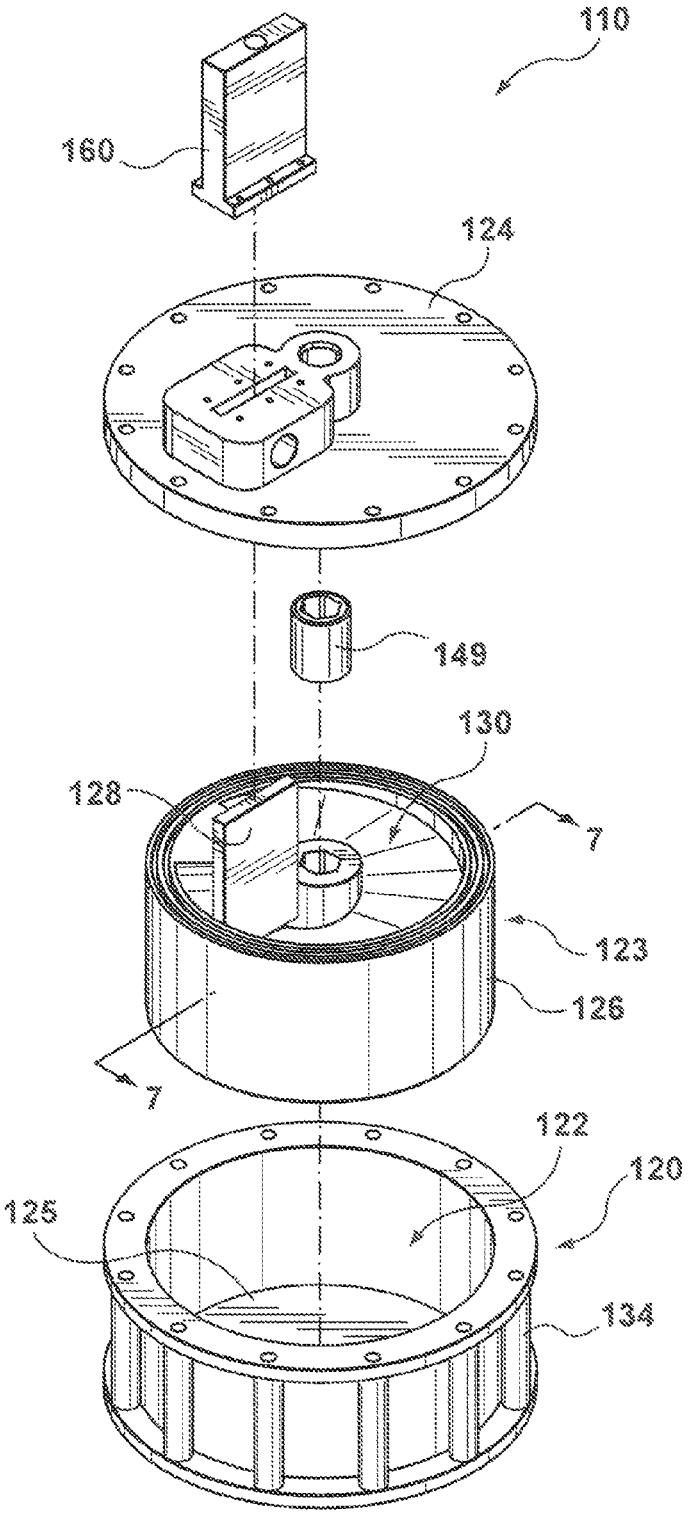
FIG. 6 is an exploded perspective view of an apparatus for compressing or pumping fluids according to another embodiment of the present invention.
Figure 7:
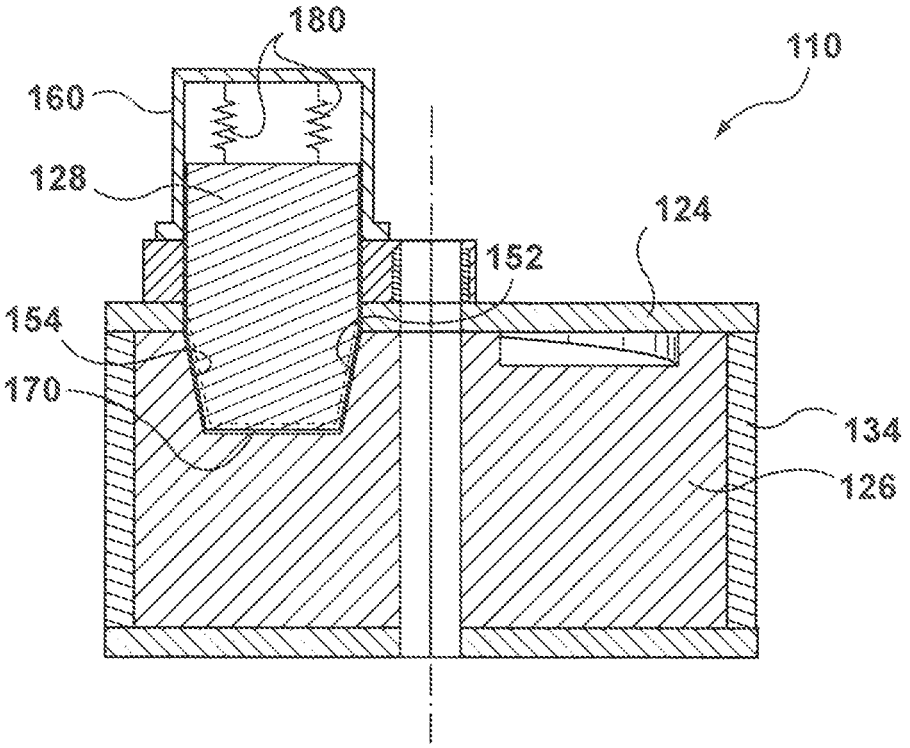
FIG. 7 is a cross-sectional view of the apparatus of FIG. 6 along the line 7-7.
Figure 8:
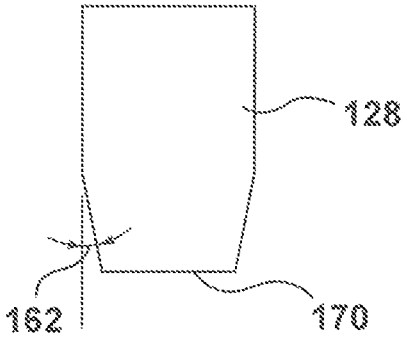
FIG. 8 is a front elevational view of a tapered end vane of the apparatus of FIG. 6.

Referring now to FIGS. 6-8, illustrated therein is another apparatus 110 for use in compressing or pumping fluids. The apparatus 110 is similar in some respects to the apparatus 10 and where appropriate similar elements are given similar reference numerals incremented by one hundred. For example, the apparatus 110 includes a housing 120 having an interior chamber 122 enclosed by a removable end wall 124, a rotating cam 123 rotatably mounted within the interior chamber 122 and comprising a cam body 126 having an end with a sloped generally annular channel 130 formed therein, and an end vane 128 slidably mounted within a slot in the end wall 124 for sliding within the sloped annular channel 130.

One difference is that the housing 120 has a solid bottom 125 integrally formed with the cylindrical shell 134. Accordingly, there is only one removable end wall 124, with one end vane 128 mounted thereto.

With reference to FIGS. 7-8, another difference is that the end vane 128 is tapered towards a vane tip 170, and the sloped annular channel 130 is formed with inner and outer circumferential sidewalls 152 and 154 that are tapered inwardly towards the ramp 150 at the same angle as the end vane 128. Tapering the end vane 128 and the sidewalls 152 and 154 can help maintain a tight seal therebetween. Specifically, if the sides and tip 170 of the end vane 128 wear down over time, the sides of the end vane 128 tend to remain in contact with the circumferential sidewalls 152 and 154 by virtue of the tapering. In contrast, with a straight-edged end vane, the sides of the end vane may wear down and a gap may develop between the sides of the end vane and the sidewalls.

In some examples, the end vane 128 may be tapered at an angle 162 of less than about 90-degrees. More particularly, the taper angle 162 may be less than about 20-degrees, or more particularly still, less than about 10-degrees. In some examples, the taper angle 162 may be larger or smaller.

As shown in FIG. 7, the end vane 128 is also biased toward the sloped annular channel 130 using one or more springs 180. The springs 180 are mounted within a vane housing 160. In some examples, the springs 180 may be omitted and the end vane 128 may be biased toward the sloped annular channel 130 in other ways, for example, using gravity.

Figure 9:
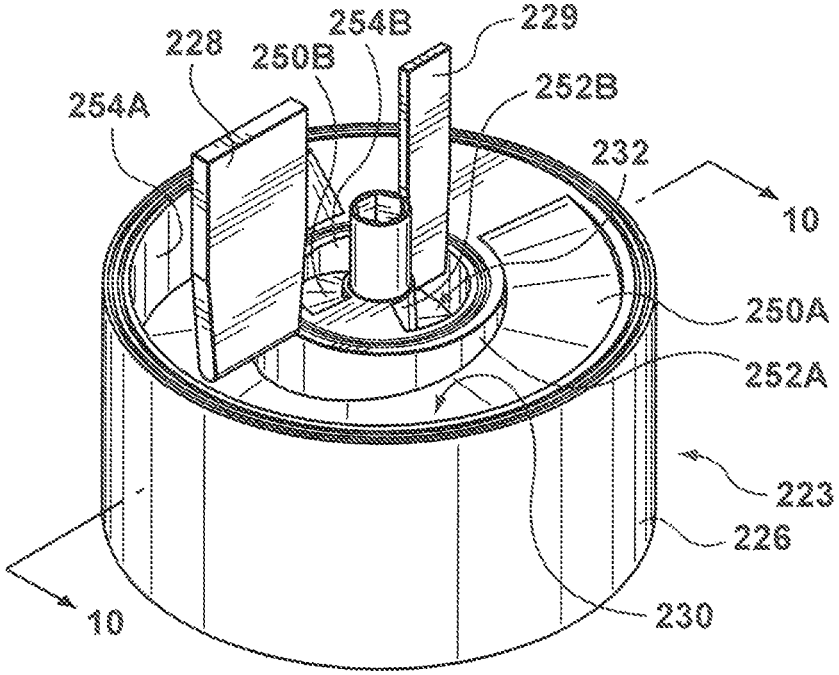
FIG. 9 is a perspective view of another rotatable cam having two concentric sloped annular channels and two end vanes therein according to another embodiment of the present invention.

Referring now to FIG. 9, illustrated therein is a rotating cam 223 and two end vanes 228 and 229 that are made in accordance with another embodiment of the invention. As shown, the rotating cam 223 comprises a cam body 226 having an end with sloped generally annular channels 230 and 232 formed concentrically therein. Each end vane 228 and 229 extends into one of the sloped annular channels 230 and 232 and is configured to slide therein as the rotating cam 223 rotates.

Figure 10:
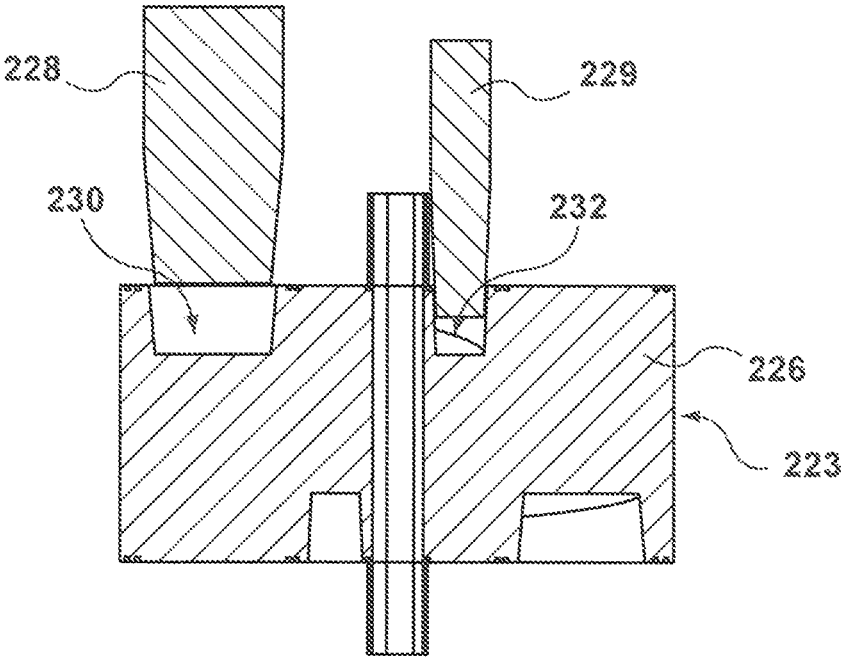
FIG. 10 is a cross-sectional view of the rotatable cam and end vanes of FIG. 9 along the line 10-10.

Each concentric sloped annular channel 230 and 232 includes its own ramp 250A and 250B, respectively. Furthermore, the ramp 250A of the outer sloped annular channel 230 is circumscribed by a first set of inner and outer circumferential sidewalls 252A and 254A, and the ramp 250B of the inner sloped annular channel 232 is circumscribed by a second set of inner and outer circumferential sidewalls 252B and 254B. The circumferential sidewalls 252A, 254A, 252B and 254B separate the sloped annular channels 230 and 232 from each other. As shown in FIG. 10, the other end of the cam body 226 also has two concentric sloped annular channels for receiving a corresponding set of end vanes (not shown).

Having two sloped annular channels on one or both ends of the cam body 226 allows multistage compression. For example, a fluid may be initially compressed within the outer annular channel 230, and then further compressed within the inner annular channel 232. In this case, a manifold block may be used to connect the outlet of the outer annular channel 230 to the inlet of the inner annular channel 232.

While the illustrated embodiment has two concentric sloped annular channels 230 and 232 on each end of the cam body 226, in other examples, there may be two or more concentric sloped annular channels on one or both ends of the cam body 226. As shown, the circumferential sidewalls of each sloped annular channel may be tapered and the end vanes may also have corresponding tapered profiles. Alternatively, the sidewalls and end vanes may be straight.

The rotating cam 223 and end vanes 228 and 229 may be used with a housing generally similar to one of the housings 20 and 120 described above, albeit with some modification to accommodate the second end vane 229 within the inner sloped annular channel 232. For example, there may be additional manifold blocks and vane housings removably attached to the end wall corresponding to each sloped annular channel and end vane therein. There may also be additional seals for separating or isolating one sloped annular channel from another.

Referring now to FIG. 11, illustrated therein is a rotating cam 323 made in accordance with another embodiment of the invention. As shown, the rotating cam 323 comprises a cam body 326 having an end with a sloped generally annular channel 330 formed therein.

As shown, the cam 323 also includes a circumferential gear 380 located on an outer circumferential surface of the cam body 326. As shown, a shaft 348 with a pinion gear 382 may be used to rotatably drive the cam gear. The rotating cam 323 may be used with a housing and end vanes generally similar to the embodiments described above, albeit with some modification to accommodate the gear 380 and pinion gear 382.

Figure 12A:
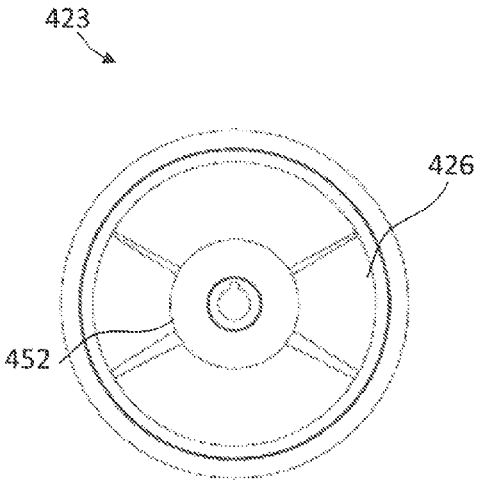
FIGS. 12A-12D are top, perspective, front, and side views, respectively, of a cam, in accordance with a further embodiment.
Figure 12B:
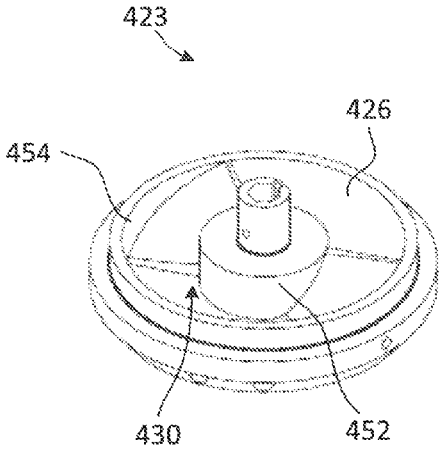
Figure 12C:
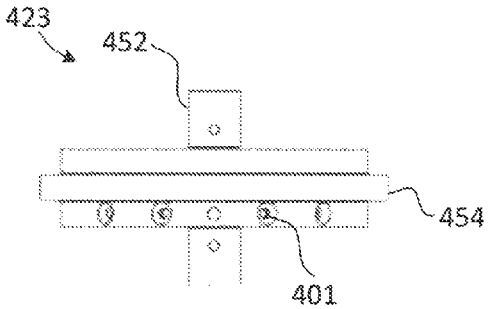
Figure 12D:
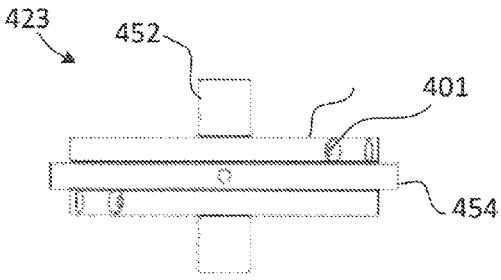
Figure 13:
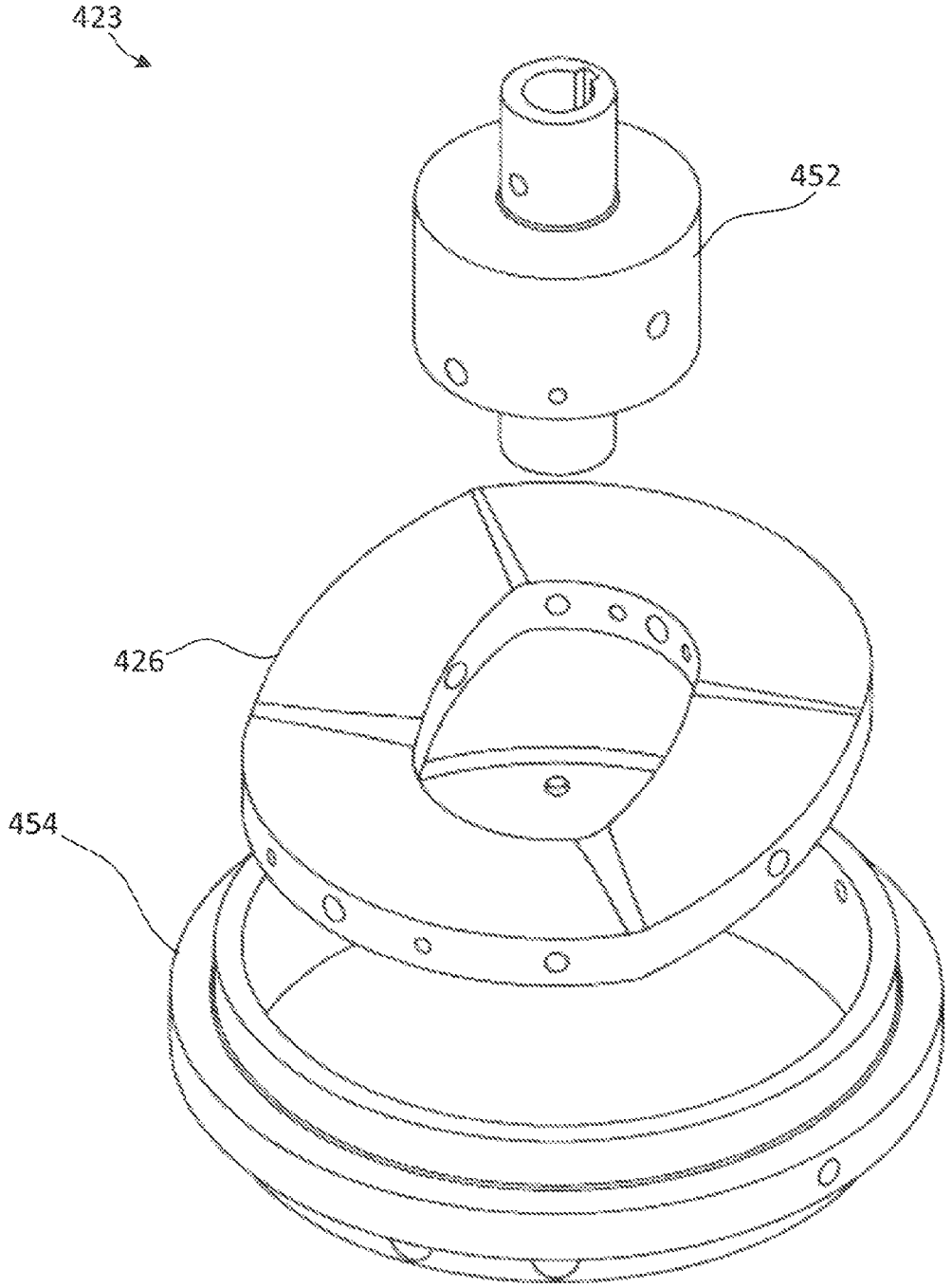
FIG. 13 is an exploded perspective view of the cam of FIGS. 12A-12D.
Figure 21:
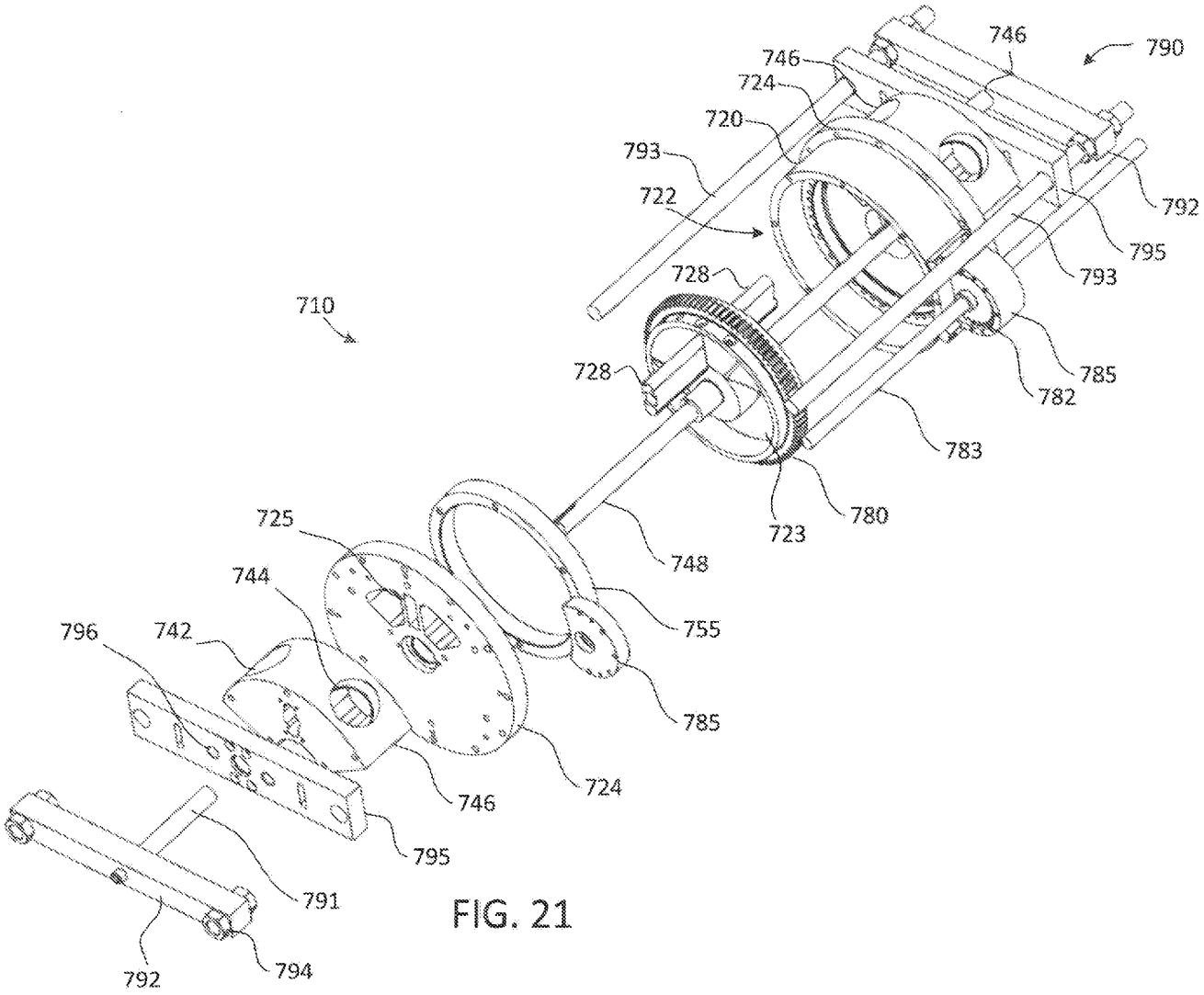
FIG. 21 is an exploded view of an apparatus for compressing or pumping fluids, according to an further embodiment.
Figure 22:
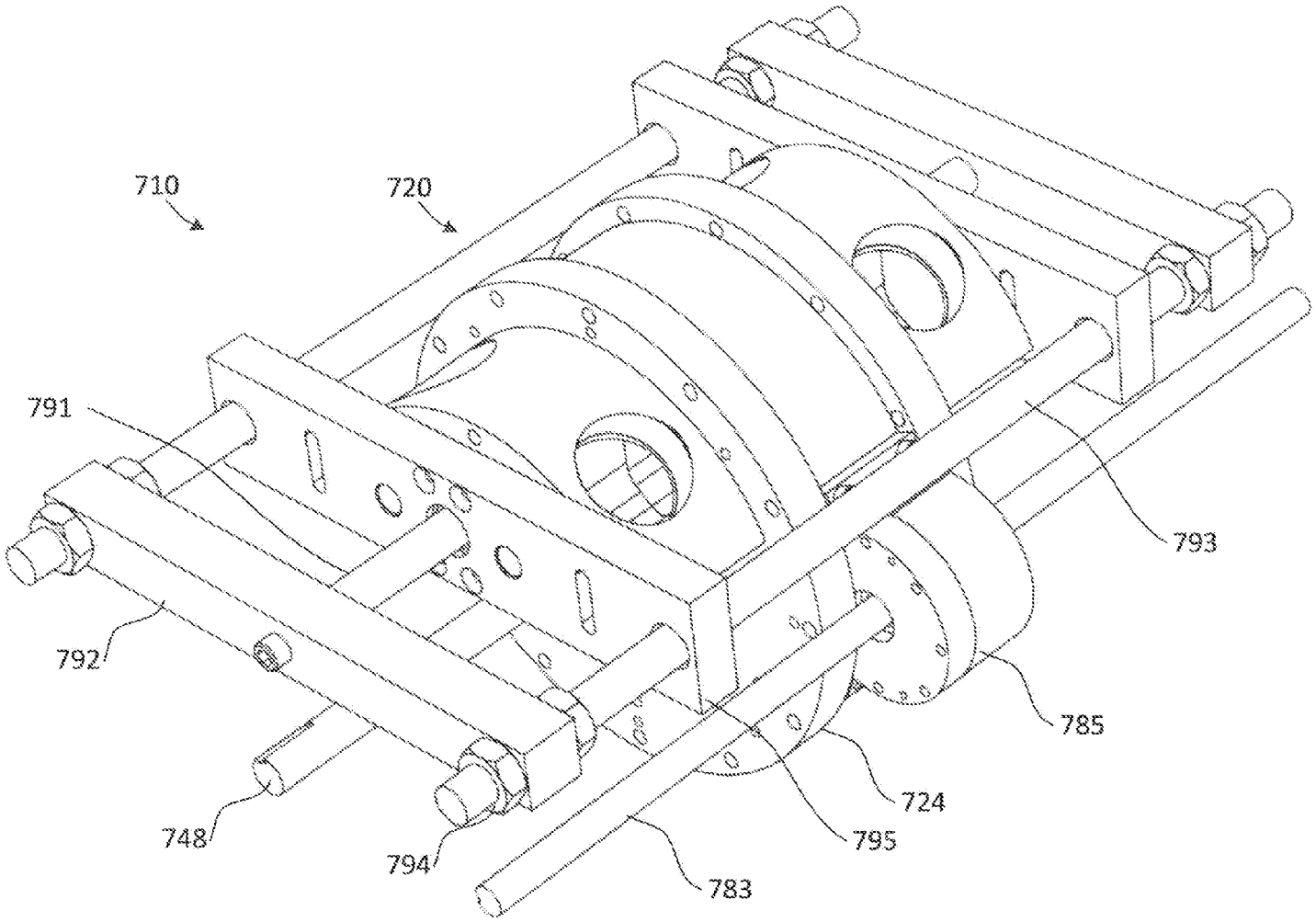
FIG. 22 is a perspective view of the apparatus of FIG. 21.
Figure 23B:
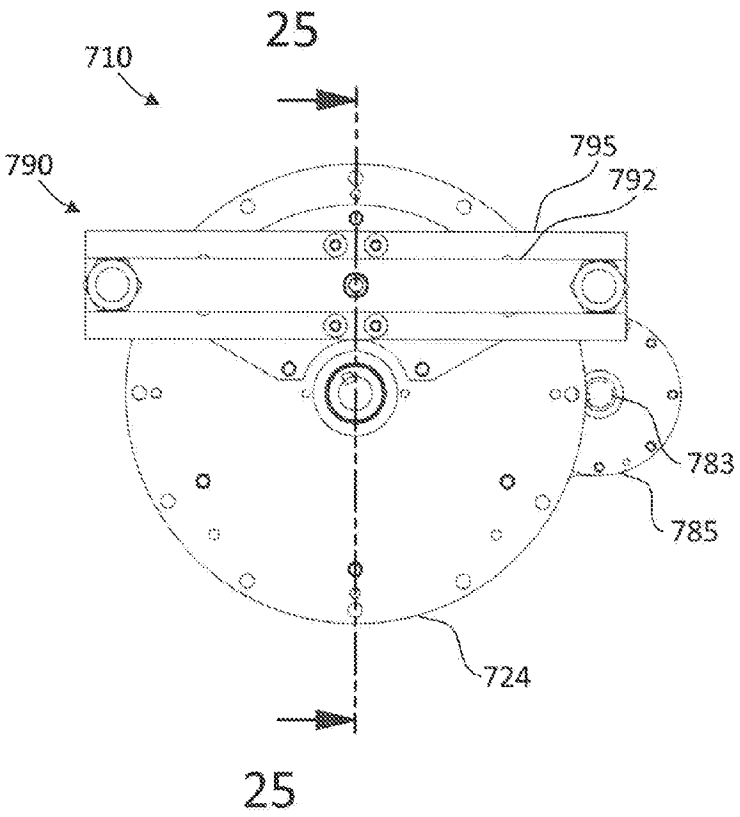
FIGS. 23A and 23B are front and bottom views, respectively, of the apparatus of FIG. 21.
Figure 23A:
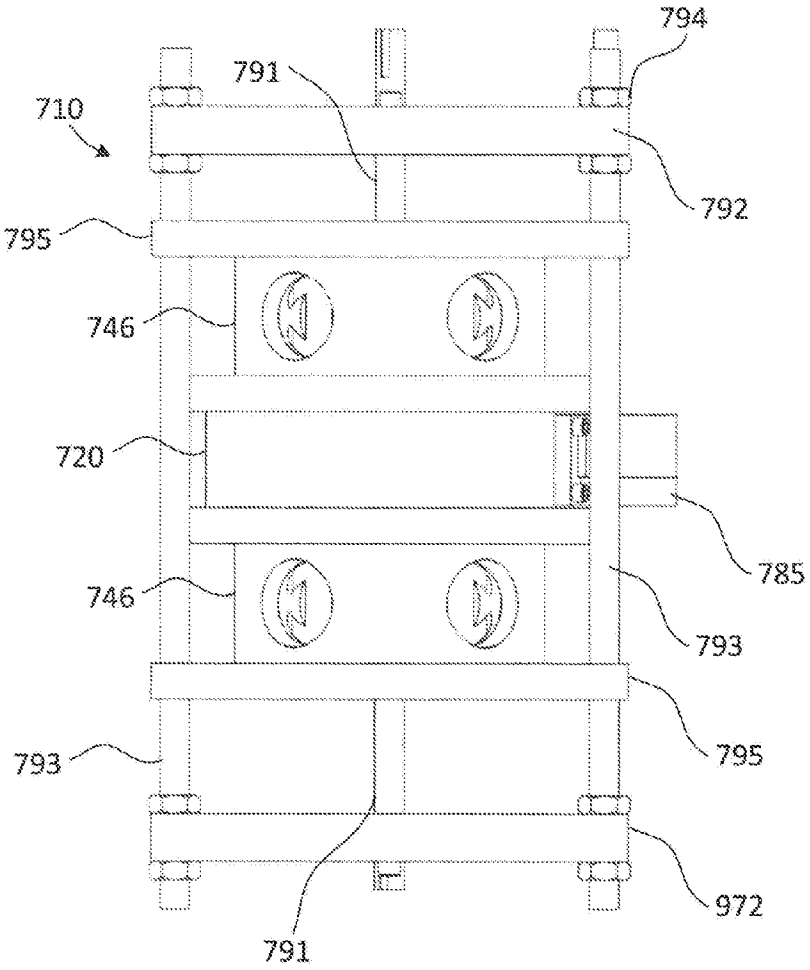
Figure 24:
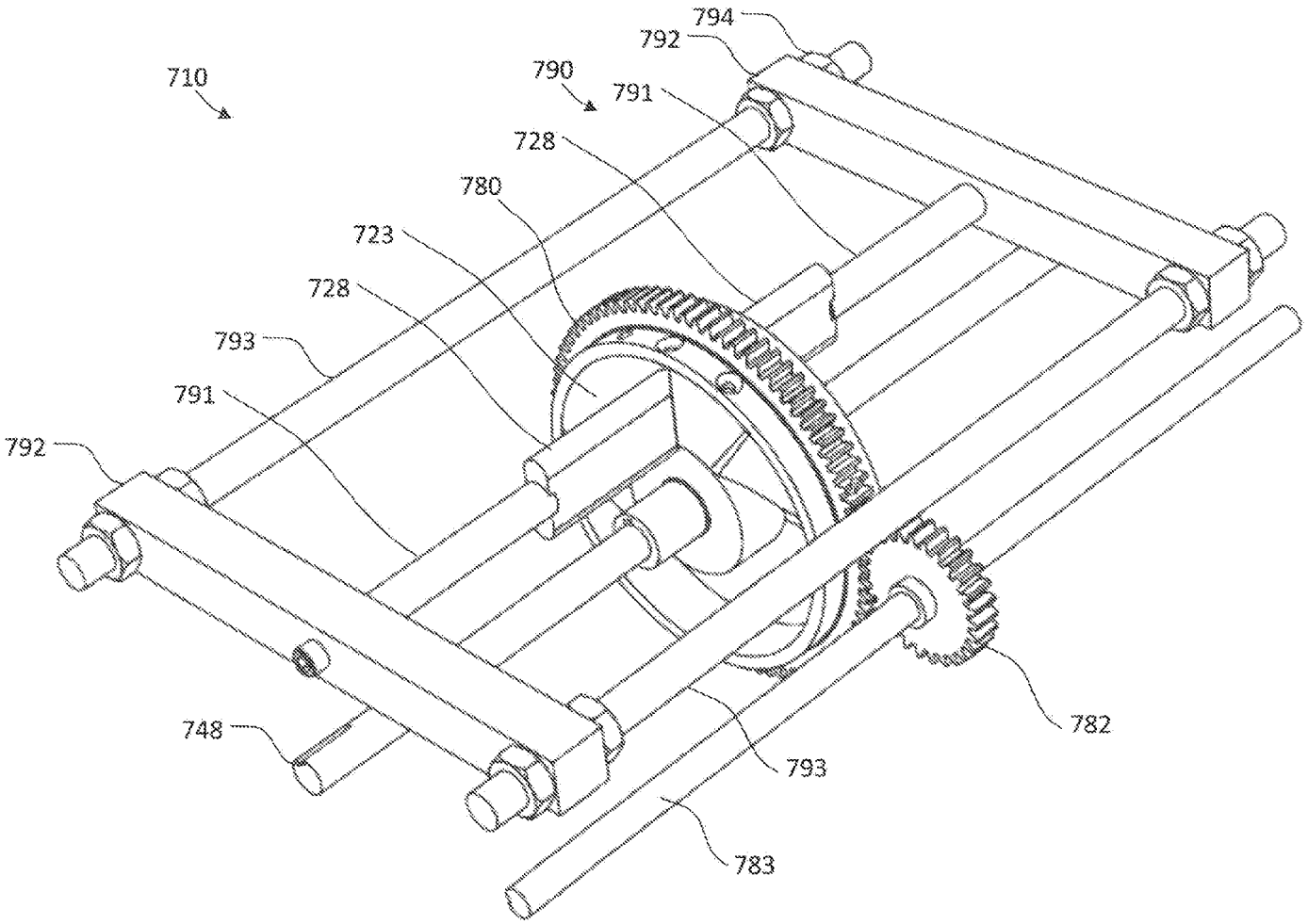
FIG. 24 is a perspective view of the apparatus of FIG. 21 having casing and support structure removed.
Figure 25:
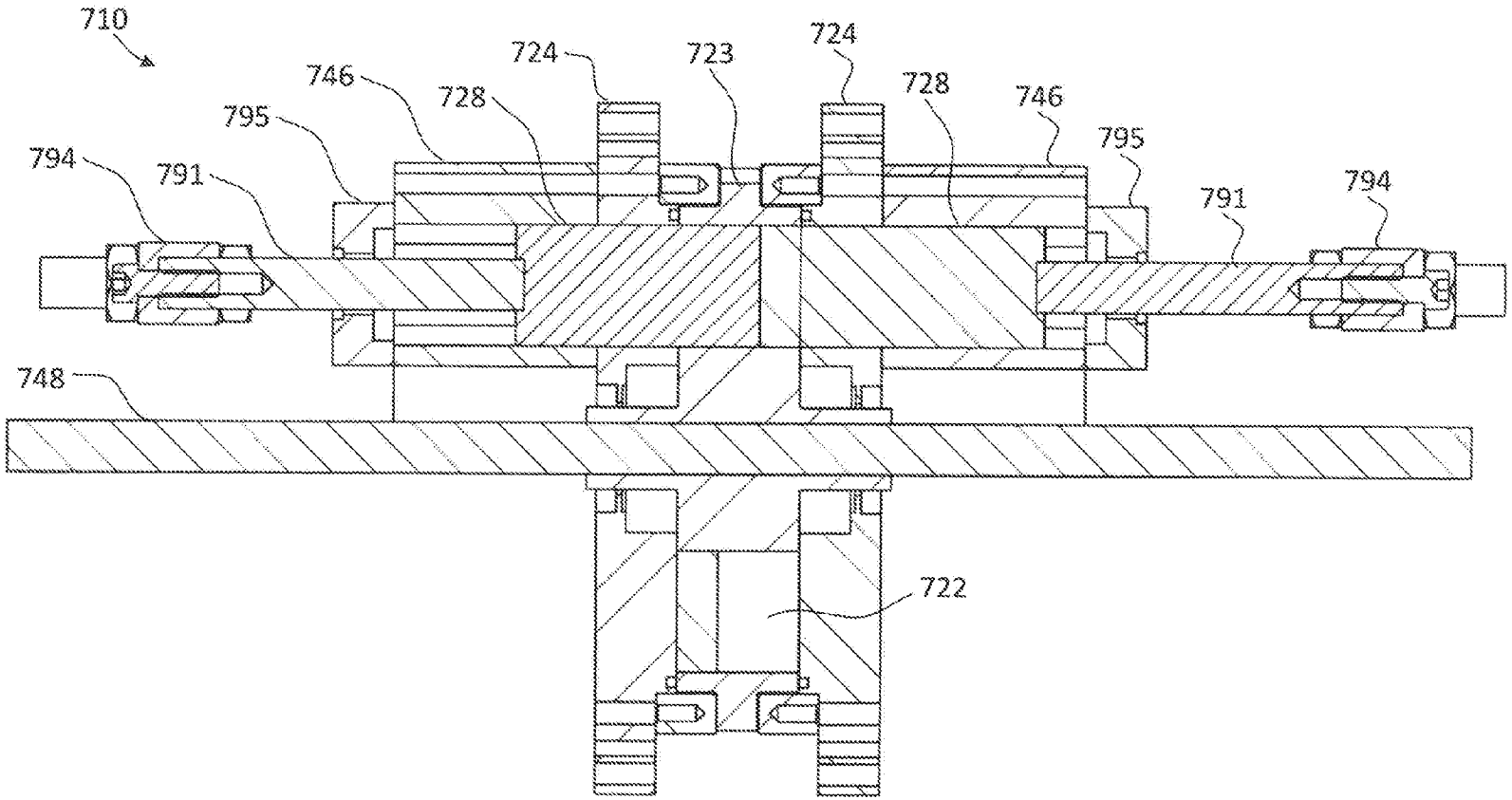
FIG. 25 is a sectional view of the apparatus of FIG. 21 along 25-25 of FIG. 23B.
Figure 26B:
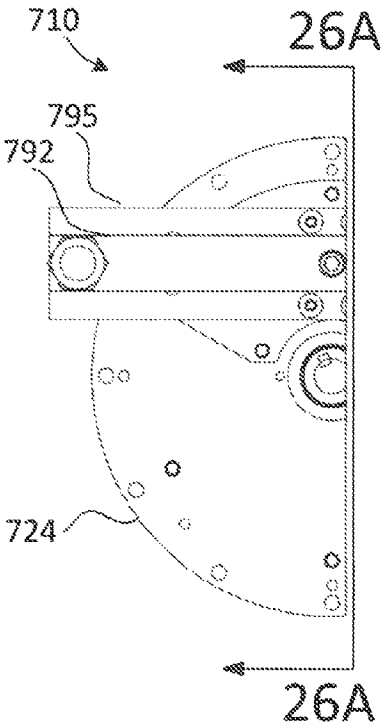
FIG. 26B is an end view of the apparatus of FIG. 21.
Figure 26A:
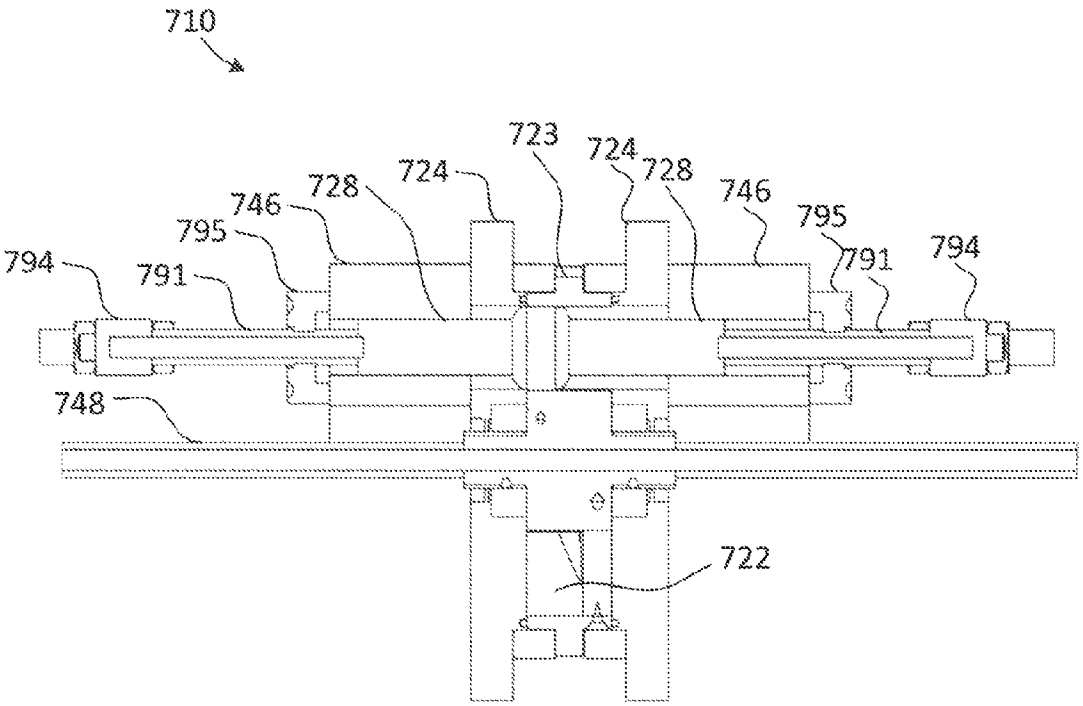
FIG. 26A is a sectional view of the apparatus of FIG. 21 along 26A-26A of FIG. 26B.

Referring now to FIGS. 12A-13, illustrated therein is a rotating cam 423, in accordance with another embodiment of the invention. The cam 423 may be used, for example, in the apparatus 710 for compressing or pumping fluid shown in FIG. 21. The cam 423 includes a reversible cam body 426 that is configured to enable the fluid to flow in a reverse direction when the rotating cam 423 is rotated in a reverse direction. The reversible cam body 426 has a generally annular channel 430 formed concentrically therein by an inner circumferential sidewall hub 452 and an outer circumferential sidewall ring 454.

In an embodiment, the reversible cam body 426 is fabricated from a three piece construction where the outer sidewall ring 454, the reversible cam body 426, and the inner sidewall hub 452 are attached together using cam attachment means 401 (for example, a plurality of threaded fasteners) such that the outer sidewall ring 454, the reversible cam body 426, and the inner sidewall hub 452 rotate together.

FIG. 14A-14D illustrates the reversible cam body 426. The cam body 426 has a raised portion 456, a lowered portion 457, a ramp up portion 450, and a ramp down portion 451 when rotating in direction A. The reversible cam body 426 is generally symmetrical and as such, the reversible cam body 426 is configured to enable fluid to flow in a forward direction (direction A) and a reverse direction. For example, the fluid will flow in the reverse direction when the reversible cam body 426 is rotated in a direction opposite to that of direction A. On the reversible cam body 426, the raised portion 456 is generally flat and sized to cover the fluid inlet and the fluid outlet (742, 744, shown at FIG. 21).

Figure 14A:
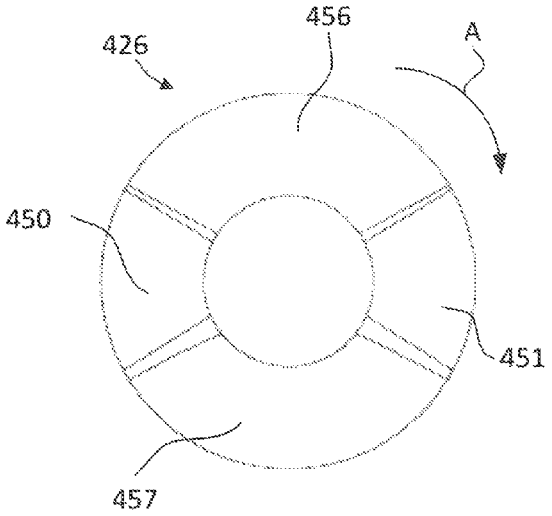
FIGS. 14A-14D are top, perspective, front, and side views, respectively, of a cam body of the cam of FIGS. 12A-12D.
Figure 14B:
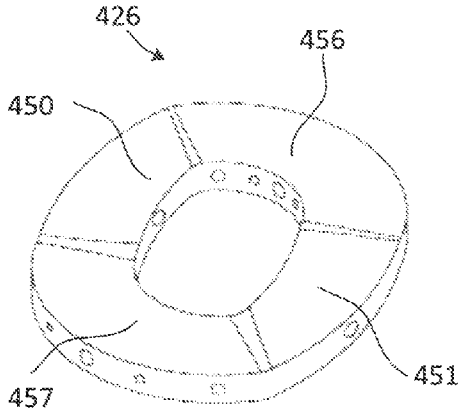
Figure 14C:
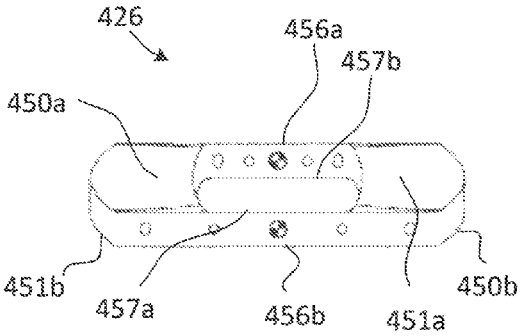
Figure 14D:
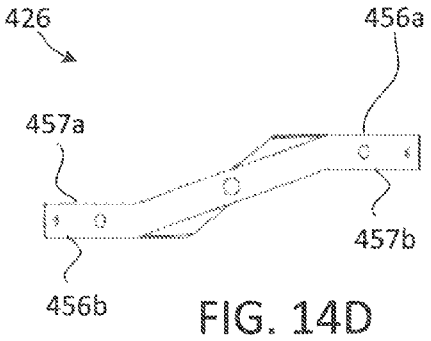

As shown at FIGS. 14C and 14D, the reversible cam body 426 is also shaped to be double-ended so that the raised portion 456*a* of a first end may also act as the lowered portion 457*b* on a second end, the lowered portion 457*a* of the first end may act as the raised portion 456*b* on the second end, the ramp up portion 450*a* of the first end acts as the ramp down portion 451*b* of the second end, and the ramp down portion 451*a* of the first end acts as the ramp up portion 450*b* of the second end. In this manner, when end vanes are operating on the surface of both ends of the reversible cam body 426, the end vanes will operate opposed to each other (for example as described with reference to FIGS. 21-26) and may provide for a reduction in overall size and materials as well as provide for an even pumping or compression flow thereby reducing pulses in the flow. Further, the reversible cam body 426 is shaped such that there is increased efficiency when emptying the cam chamber (e.g. chamber 722 of FIG. 21) as the slope of the ramp up 450 and ramp down 451 portions is lengthened.

Figure 15A:
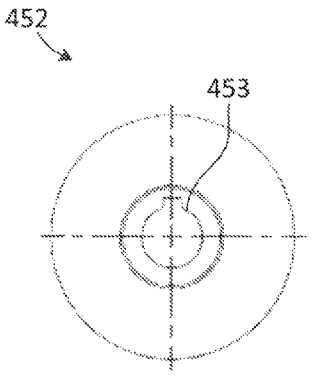
FIGS. 15A and 15B are top and perspective views, respectively, of an inner sidewall hub of the cam of FIGS. 12A-12D.
Figure 15B:
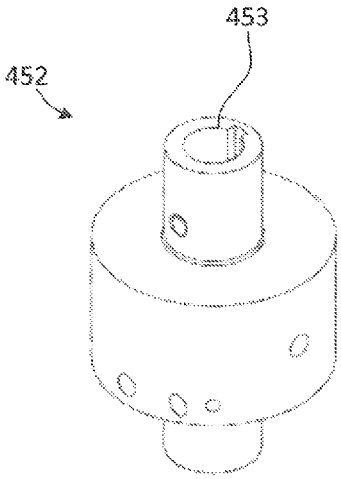

FIGS. 15A and 15B illustrate the inner sidewall hub 452. The inner sidewall hub has a keyed slot 453 for attaching to a first drive shaft (e.g. first drive shaft 748 of FIG. 21).

Figure 16A:
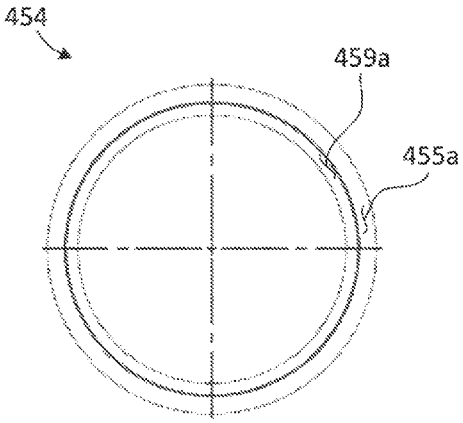
FIGS. 16A and 16B are top and perspective views, respectively, of an outer sidewall ring of the cam of FIGS. 12A-12D.
Figure 16B:
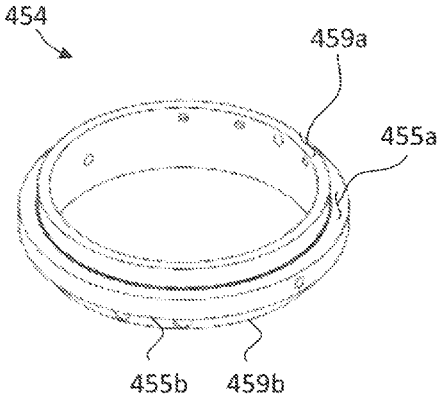

FIGS. 16A and 16B illustrate the outer sidewall ring 454. The outer sidewall ring 454 has a seal surface 459 to seal the inner chamber (e.g. chamber 722 of FIG. 21). The outer sidewall ring 454 has a bearing surface 455 to reduce bearing thrust forces when the cam 423 is rotating. Where the cam 423 is configured for double-ended use, the seal surface 459 may be on both an upper seal surface 459*a* and a lower seal surface 459*b*, and the bearing surface 455 may be on both an upper surface 455*a* and a lower surface 455*b* of the outer sidewall ring 454.

Figure 17A:
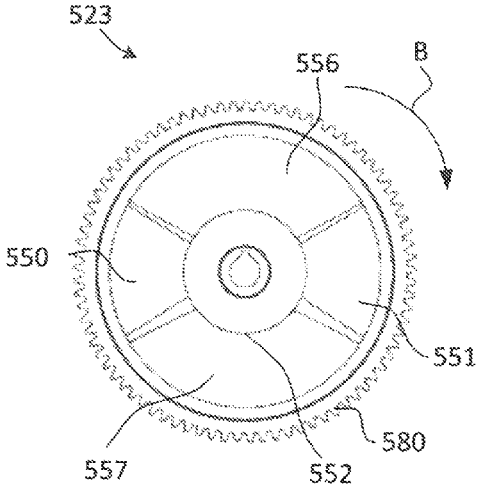
FIGS. 17A-17D are top, perspective, front, and side views, respectively, of a cam having a circumferential gear, in accordance with a further embodiment.
Figure 17B:
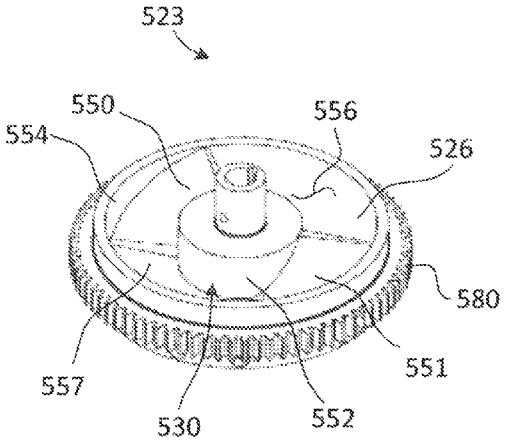
Figure 17C:
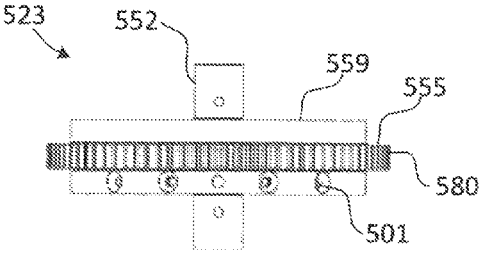
Figure 17D:
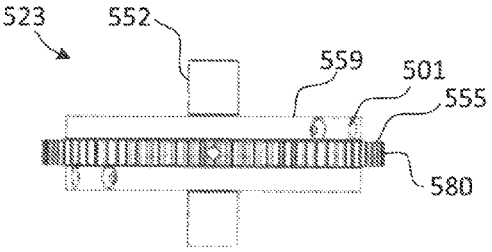
Figure 18:
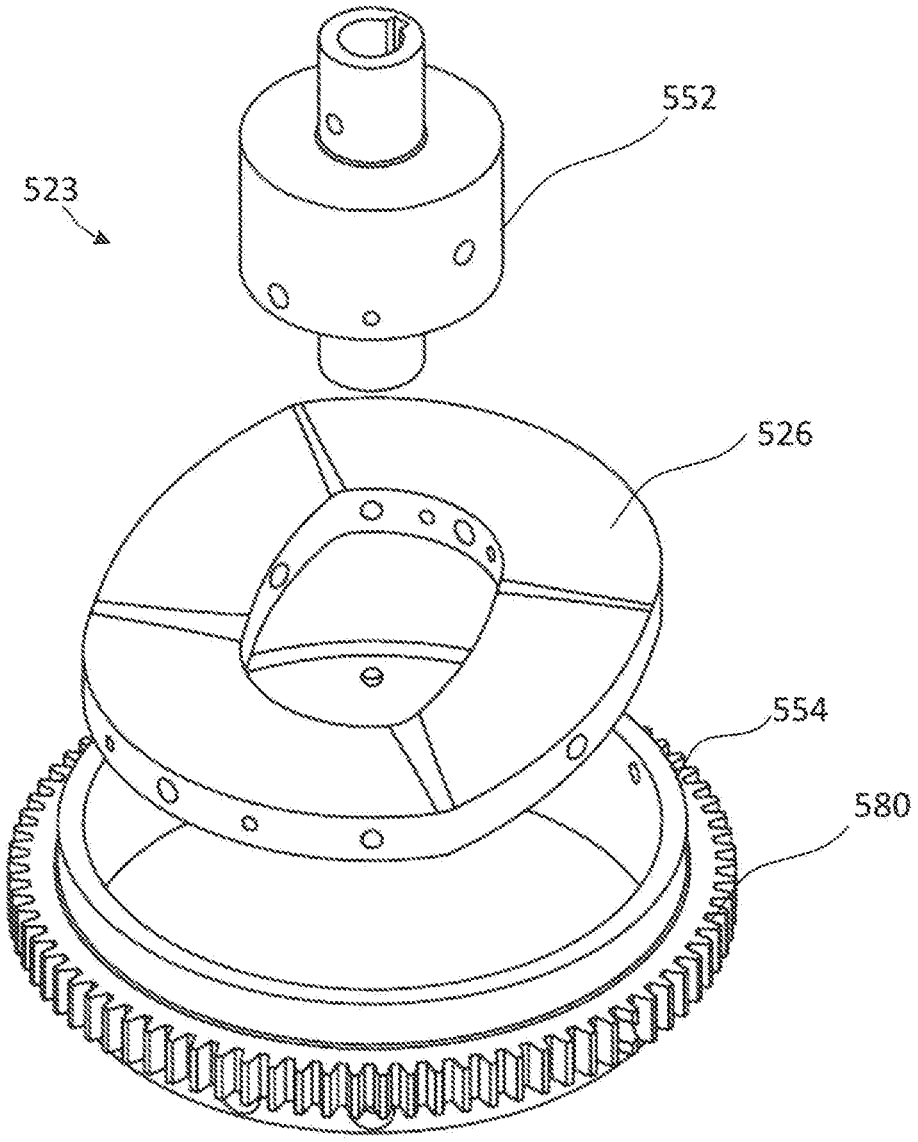
FIG. 18 is an exploded perspective view of the cam of FIGS. 17A-17D.

Referring now to FIGS. 17A-18, illustrated therein is a rotating cam 523, in accordance with another embodiment of the invention. The rotating cam 523 may be used, for example, in the apparatus 610 for compressing or pumping fluid shown in FIG. 20B or the apparatus 710 for compressing or pumping fluid shown in FIG. 21. The cam 523 includes a circumferential gear 580 located on an outer circumferential surface of the cam body 526 which is driven by a second drive shaft (e.g. drive shaft 783 of FIG. 21).

Figure 19A:
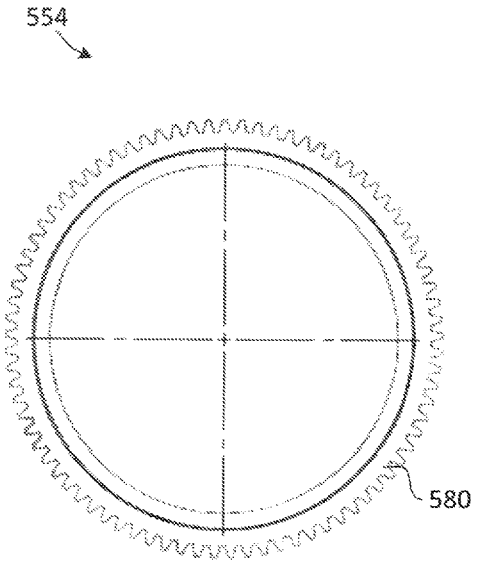
FIGS. 19A and 19B are top and perspective views, respectively, of an outer sidewall ring of the cam of FIGS. 17A-17D.
Figure 19B:
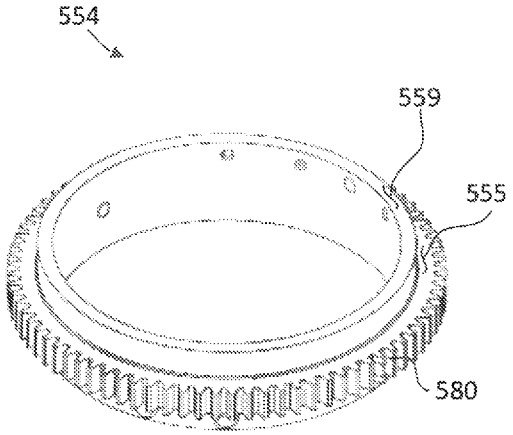

As similarly described with reference to FIGS. 12A-16B, FIGS. 17A-18 illustrate the rotating cam 523, and FIGS. 19A and 19B illustrate an outer sidewall ring 554. The cam 523 includes a reversible cam body 526 having a sloped generally annular channel 530 formed concentrically therein by an inner circumferential sidewall hub 552 and an outer circumferential sidewall ring 554 attached together by cam attaching means 501. The reversible cam body 526 has a raised portion 556, a lowered portion 557, a ramp up portion 550, and a ramp down portion 551 when rotating in direction B. The outer sidewall ring 554 has a seal surface 559 and a bearing surface 555.

Figure 20A:
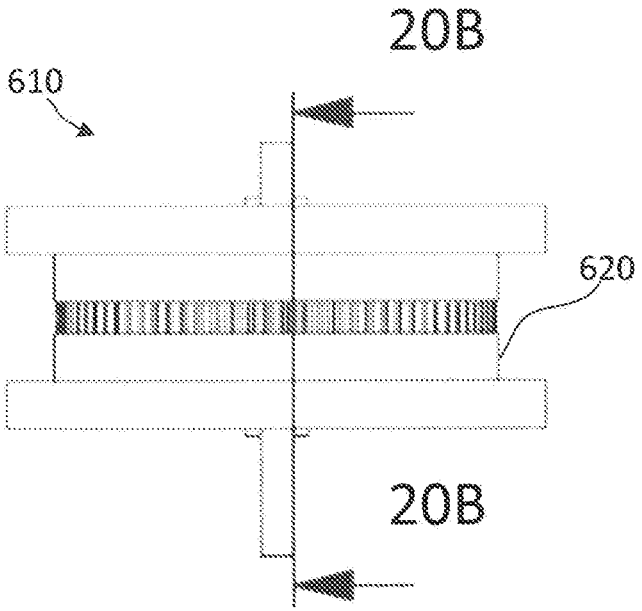
FIGS. 20A and 20B are a front view and a sectional view along 20B-20B of FIG. 20A of an apparatus for compressing or pumping fluid, in accordance with a further embodiment.
Figure 20B:
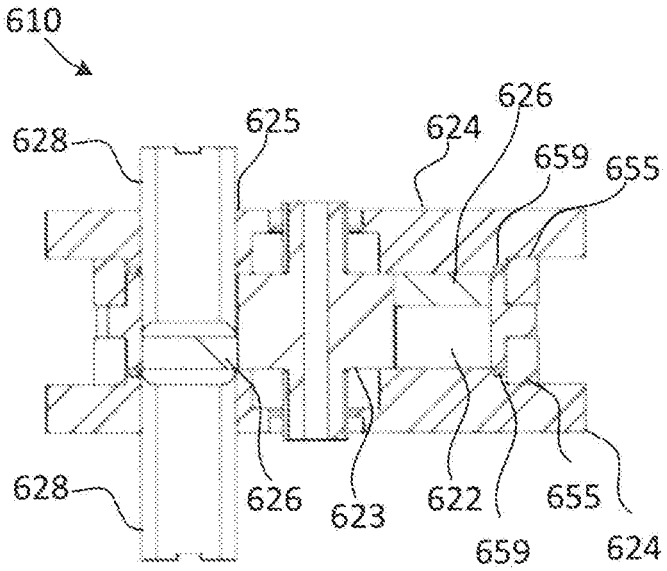

FIGS. 20A and 20B illustrate an apparatus 610 for use in compressing or pumping fluids, in accordance with a further embodiment. The apparatus 601 may use, for example the cam 523 as described with reference to FIGS. 17-19B. The apparatus 610 includes a housing 620 having an interior chamber 622 enclosed by two end walls 624. A rotating cam 623 is rotatably mounted within the interior chamber 622, and two end vanes 628 are slidably mounted within a slot 625 in the end walls 624. The rotating cam 623 comprises a reversible cam body 626 having two cam surfaces for double-ended use.

The apparatus 610 includes seals 659 for sealing the inner chamber 622. The apparatus 610 includes bearings 655 that ride on bearing surfaces (e.g., bearing surface 555) for controlling thrust forces acting on the cam 623 when rotating.

Referring now to FIGS. 21-26B, illustrated therein is another apparatus 710 for use in compressing or pumping fluids. The apparatus 710 is similar in some respects to the apparatus 10. The apparatus 710 includes a housing 720 having an interior chamber 722 enclosed by two removable end walls 724, a rotating cam 723 rotatably mounted within the interior chamber 722, and two end vanes 728 slidably mounted within a slot 725 in the end walls 724 for sliding on the cam 723. The apparatus 710 may also have bearings 755 for riding between the cam 723 and the end wall 724. The apparatus 710 may also include a manifold block 746 attached to each end wall 724. Each manifold block 746 may be formed with a fluid inlet 742 and a fluid outlet 744 therein.

The cam 723 may be, for example, the cam 423 as described with reference to FIGS. 12-16B or the cam 523 as described with reference to FIGS. 17-19B having a circumferential gear 780. The apparatus 710 has a first drive shaft 748 and, where the cam has the circumferential gear, a second drive shaft 783. The second drive shaft 783 has a pinion gear 782 for turning the cam 723 which is housed by a secondary drive gear case 785.

The second drive shaft 783 may provide more power to the cam 723 and accordingly put less stress on the first drive shaft 748. This may provide a higher strength apparatus that can operate under higher internal pressure as there is reduced torque put on the first drive shaft 748. When driving the cam 723 at slow speeds, the apparatus 710 may push fluid through at the same speed as desirable for the intake conduit. For example, the apparatus 710 may be operated by a hand-crank or a donkey-wheel from either the first or second drive shafts 748, 783. The second drive shaft 783 may have a gear ratio to the circumferential gear 780 such that there is a decreased speed.

Where the apparatus 710 has the reversible cam body 526 as described with reference to FIGS. 13A-13B, the apparatus may have a connection assembly 790 to mechanically tie the end vanes 728 together such that the end vanes 728 move together. The end vanes 728 are on opposite ends of the cam 723 at the same location. The connection assembly 790 includes push rods 791 that attach at a first end to the end vane 728 and at a second end to a tie bar 792. A tie rod 793 connects to the tie bar 792 of the opposite end vane 728 and can be adjusted using tie rod adjustment nuts 794. The tie rod 793 and the push rod 791 may be supported by a rod guide 795. The rod guide 795 may have a vane socket vent 796 for venting any fluid trapped in the chamber between the end vane 728 and the rod guide 795. Venting this chamber reduces pressure build-up which could place unnecessary force on the end vane 728 or possibly hydraulically locking the end vane 728 in place during the travel, extension or retraction, of the end vane 728.

Where the end vanes 728 are tied together, the connection assembly 790 acts as the biasing means to slide the end vanes 728 along the surface of the cam 723. Where there is a high viscosity, heavy, thick, and/or sticky fluid used in the apparatus 710, the connection assembly 790 may provide for improved pulling of the end vanes back into the manifold block 746. Further, where there is high wear on the end vanes 728, there may be improved opportunity to replace the end vanes 728 when worn out.

In a further embodiment, the apparatus 710 may have an additional chamber, for example as described with respect to FIGS. 9 and 10. With the additional chambers, the fluid is a gas to be compressed. The ramps (e.g. the ramp-up portion) are offset by (1/n)*360 degrees, where n is the number of chambers, which may provide for a more consistent stress on the cam. For example, where there are two chambers, the ramps are be offset by 180 degrees. Where there are three chambers, the ramps may be offset by 120 degrees. The first, second and/or subsequent chambers, may operate in series from the outer chamber to the inner chamber and increase pressure in the subsequently smaller chambers which may have increased emptying when compressing to increase efficiency.

In an alternate embodiment, the end vane may be cross shaped (not shown) to provide for further strength due to forces acting tangentially on the end vane and may prevent twisting of the end vane.

While the above description provides examples of one or more apparatus, methods, or systems, it will be appreciated that other apparatus, methods, or systems may be within the scope of the present description as interpreted by one of skill in the art.

The invention claimed is:

1. An apparatus for compressing or pumping fluid, the apparatus comprising:

a housing having an interior chamber, the housing including a first end wall on one side of the interior chamber, the first end wall having a fluid inlet and a fluid outlet;

a rotating cam rotatably mounted within the interior chamber, the rotating cam comprising a reversible cam body configured to enable fluid to flow in a forward direction and a reverse direction, the reversible cam body having a first end located adjacent to the first end wall, the first end having a first sloped annular channel formed therein, the first end of the reversible cam body including a ramp up portion, a ramp down portion, and inner and outer circumferential sidewalls that circumscribe the ramp to define the first sloped annular channel; and a first end vane slidably mounted within a slot in the first end wall so as to extend into the first sloped annular channel for sliding therein as the rotating cam rotates, the first end vane being biased towards the ramp so as to divide the sloped annular channel into an inlet chamber and an outlet chamber such that, as the rotating cam rotates, the inlet chamber expands and communicates with the fluid inlet for receiving the fluid, and the outlet chamber contracts and communicates with the fluid outlet for expelling the fluid.

2. The apparatus of claim 1, wherein the reversible cam body includes a raised portion and a lowered portion, wherein the raised portion is generally flat and sized to cover the fluid inlet and the fluid outlet.

3. The apparatus of claim 2, wherein the housing has a second end wall on an opposite side of the interior chamber, the second end wall having a fluid inlet and a fluid outlet; and wherein the reversible cam body has a second end located adjacent to the second end wall, the second end having a second sloped annular channel formed therein, wherein the reversible cam body is double-ended such that the ramp up portion of the first end acts as a ramp down portion of the second end, the ramp down portion of the first end acts as a ramp up portion of the second end, the raised portion of the first end acts as a lowered portion of a second end, and the lowered portion of the first end acts as a raised portion on the second end.

4. The apparatus of claim 3 further comprising a second end vane located in a same location on opposite sides of the rotating cam, wherein the second end vane is slidably mounted within a slot in the second end wall so as to extend into the second sloped annular channel for sliding therein as the rotating cam rotates.

5. The apparatus of claim 4 further comprising a connection assembly for mechanically tying the first and second end vanes together such that the end vanes move together.

6. The apparatus of claim 5, wherein the connection assembly comprises:

a first push rod attached to the first end vane and a first tie bar;

a second push rod attached to the end second vane and a second tie bar; and a tie rod for connecting the first and second push rods.

7. The apparatus of claim 6 further comprising a rod guide for supporting the tie rod and the first and second push rods.

8. The apparatus of claim 1 further comprising at least one bearing guide ring for bearing on the outer circumferential sidewall.

9. The apparatus of claim 1, wherein each end of the cam body has at least two interior chambers arranged concentrically therein.

10. The apparatus of claim 9, wherein the ramp up portions of the at least two interior chambers are offset from each other by (1/n)*360 degrees, where n is the number of interior chambers.

11. An apparatus for compressing or pumping fluid, the apparatus comprising:

a housing having an interior chamber, the housing including a first end wall on one side of the interior chamber, the first end wall having a fluid inlet and a fluid outlet;

a rotating cam rotatably mounted within the interior chamber, the rotating cam comprising:

a reversible cam body configured to enable fluid to flow in a forward direction and a reverse direction, the reversible cam body having a first sloped annular channel formed therein, the first end of the reversible cam body including a ramp up portion, a ramp down portion, and inner and outer circumferential sidewalls that circumscribe the ramp to define the first sloped annular channel; and a circumferential cam gear located on the outer circumferential sidewall; and a secondary drive shaft with a pinion gear to rotate the circumferential cam gear; and a first end vane slidably mounted within a slot in the first end wall so as to extend into the first sloped annular channel for sliding therein as the rotating cam rotates, the first end vane being biased towards the ramp so as to divide the sloped annular channel into an inlet chamber and an outlet chamber such that, as the rotating cam rotates, the inlet chamber expands and communicates with the fluid inlet for receiving the fluid, and the outlet chamber contracts and communicates with the fluid outlet for expelling the fluid.

12. The apparatus of claim 11, wherein the reversible cam body includes a raised portion and a lowered portion, wherein the raised portion is generally flat and sized to cover the fluid inlet and the fluid outlet.

13. The apparatus of claim 12, wherein the housing has a second end wall on an opposite side of the interior chamber, the second end wall having a fluid inlet and a fluid outlet; and wherein the reversible cam body has a second end located adjacent to the second end wall, the second end having a second sloped annular channel formed therein, wherein the reversible cam body is double-ended such that the ramp up portion of the first end acts as a ramp down portion of the second end, the ramp down portion of the first end acts as a ramp up portion of the second end, the raised portion of the first end acts as a lowered portion of a second end, and the lowered portion of the first end acts as a raised portion on the second end.

14. The apparatus of claim 13 further comprising a second end vane located in a same location on opposite sides of the rotating cam, wherein the second end vane is slidably mounted within a slot in the second end wall so as to extend into the second sloped annular channel for sliding therein as the rotating cam rotates.

15. The apparatus of claim 14 further comprising a connection assembly for mechanically tying the first and second end vanes together such that the end vanes move together.

16. The apparatus of claim 15, wherein the connection assembly comprises:

a first push rod attached to the first end vane and a first tie bar;

a second push rod attached to the second end vane and a second tie bar; and a tie rod for connecting the first and second push rods.

17. The apparatus of claim 16 further comprising a rod guide for supporting the tie rod and the first and second push rods.

18. The apparatus of claim 11 further comprising at least one bearing guide ring for bearing on the outer circumferential sidewall.

19. The apparatus of claim 11, wherein each end of the cam body has at least two interior chambers arranged concentrically therein.

20. The apparatus of claim 19, wherein the ramp up portions of the at least two interior chambers are offset from each other by (1/n)*360 degrees, where n is the number of interior chambers.

21. The apparatus of claim 1, wherein the ramp up portion and the ramp down portion are symmetrically configured such that when the rotating cam is rotated in a reverse direction the ramp up portion acts as a ramp down portion and the ramp down portion acts as a ramp up portion.

* * * * *